US006692302B1

(12) United States Patent
Tsuji et al.

(10) Patent No.: US 6,692,302 B1
(45) Date of Patent: Feb. 17, 2004

(54) CONNECTOR A TERMINAL FITTING AND A DISENGAGEMENT JIG

(75) Inventors: Takeshi Tsuji, Yokkaichi (JP); Hideto Nakamura, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/234,292

(22) Filed: Sep. 3, 2002

(30) Foreign Application Priority Data

Apr. 9, 2001 (JP) ..... 2001-268066
May 9, 2001 (JP) ..... 2001-269540
Apr. 3, 2002 (JP) ..... 2002-057775

(51) Int. Cl.[7] ..... H01R 13/40
(52) U.S. Cl. ..... 439/595
(58) Field of Search ..... 439/595, 744, 439/752, 871

(56) References Cited

U.S. PATENT DOCUMENTS 5,186,662 A * 2/1993 Yuasa et al. ..... 439/752
5,575,684 A 11/1996 Uchida et al.
5,607,327 A * 3/1997 Tsuji et al. ..... 439/752
5,730,627 A * 3/1998 Okabe ..... 439/752
5,755,600 A * 5/1998 Yoshida ..... 439/752
6,375,502 B2 * 4/2002 Yoshida et al. ..... 439/595
2001/0003076 A1 6/2001 Kodama

FOREIGN PATENT DOCUMENTS

EP 1 094 572 A1 4/2001
JP 6-325814 11/1994

* cited by examiner

*Primary Examiner*—Neil Abrams
*Assistant Examiner*—Thanh-Tam Le
(74) *Attorney, Agent, or Firm*—Gerald E. Hespos; Anthony J. Casella

(57) ABSTRACT

A connector housing (20) has cavities (21) and locks (31) for engaging terminal fittings (10) inserted into the cavities (21). Each lock (31) has an arm (32) and a locking section (33) that projects up from the arm (32). A mold-removal hole (35) is formed in a front wall (27) and in the arm (32). A tab insertion hole (28) is formed in the front wall (27) above the mold-removal hole (35) for receiving a tab terminal (T), and a guide surface (29) is formed at the front edge of the tab insertion hole (28) for guiding the tab (T). Upwardly narrowed portions (38) narrowed are formed on the locking section (33) and have a height overlapping the height of the guide surface (29). Portions of the mold-removal hole (35) corresponding to the narrowed portions (38) define an M-shaped when viewed from the front.

19 Claims, 19 Drawing Sheets

CONNECTOR A TERMINAL FITTING AND A DISENGAGEMENT JIG

BACKGROUND OF THE INVENTION

1. Field of the Invention

The present invention relates to a connector, a terminal fitting and a disengagement jig.

2. Description of the Related Art

Japanese Unexamined Patent Publication No. 6-325814 and FIG. 28 herein disclose a connector with a housing 1 and terminal fittings 2. The housing 1 is formed with cavities 3, and the terminal fittings 2 are insertable into the cavities 3 from behind. A deformation permitting space 4 is formed adjacent each cavity 3 and a resin lock 5 is formed between the cavity 3 and the deformation permitting space 4. The lock 5 deforms into the deformation permitting space 4 in response to pushing forces exerted by the terminal fitting 2. However, the lock 5 is restored resiliently to engage the terminal fitting 2 when the terminal fitting 2 reaches a proper depth. Each lock 5 has an arm 6 that is cantilevered forward from the upper wall of the cavity 3 and a locking projection 7 that projects into the cavity 3 from the inner surface of the leading end of the arm 6 to engage the terminal fitting 2. Each cavity 3 has a front wall 8 with a tab insertion hole 9 for insertion of a mating tab terminal into the cavity. A mold-removal hole 5*a* is formed above the tab insertion hole 9, and is used to remove a mold pin for forming the locking projection 7 during the molding of the housing 1. A guide surface 9*a* is formed around the periphery of the tab insertion hole 9 for guiding the tab terminal into the tab insertion hole 9.

A demand exists to reduce the size of the above-described connector. Accordingly, the terminal fittings 2, the cavities 3 and the locks 5 are made smaller. However, the resin locks 5 are less rigid than the metal terminal fittings 2 and the locks 5 must have a minimum size to obtain a required force to lock the terminal fittings 2. Thus, if the cavities 3 and the terminal fittings 2 are made smaller while setting the size of the resin locks 5 at a specified fixed size, the projecting ends of the locking projections 7 of the locks 5 reach a height overlapping the guide surfaces 9*a*. Consequently, the mold-removal holes 5*a* for the locks 5 effectively reduce the areas of the guide surfaces 9*a*, and impede the ability to guide a misaligned tab into the tab insertion hole 9.

A disengagement jig can be inserted into the mold-removal hole 5*a* from the front and can be maneuvered to deform the lock 5 so that the terminal fitting 2 can be removed. However, the jig becomes narrower and weaker as the opening area of the mold-removal holes 5*a* becomes smaller.

Forces generated during a disengaging operation could deform of the resin lock 5 excessively. Thus, an excessive deformation-preventing wall 6 is provided on the side of the deformation space 4 opposite the resin lock 5. The excessive deformation-preventing wall 6 engages the resin lock 5 and prevents the resin lock 5 from deforming beyond its resiliency limit.

The resin lock 5, the deformation space 4 and the excessive deformation-preventing wall 6 are provided one over another along the height direction, and tend to make the connector very tall.

In view of the above, an object of the invention is to improve the operational efficiency of a connector.

SUMMARY OF THE INVENTION

The invention is relates to a connector with a housing that has at least one cavity. A terminal fitting is insertable into the cavity from behind and is electrically connectable with a mating tab terminal. The housing has a front wall with a tab insertion hole that permits entry of the tab terminal into the cavity. The front edge of the tab insertion hole has a guide surface for guiding the tab terminal into the tab insertion hole. A resiliently deflectable lock is at an inner surface of the cavity, and is engageable with the terminal fitting inserted into the cavity. Part of the lock overlaps the guide surface with respect to the height direction. A mold-removal hole penetrates the front wall of the cavity and cuts off a portion of the guide surface corresponding to the overlapping part as a mold for forming the lock is removed forward. The overlapping part of the lock is narrowed toward its upper side, and the mold-removal hole preferably is formed along the outer periphery of the narrowed portion.

Accordingly, it is possible to guide a tab terminal smoothly into a tab insertion hole. The terminal fitting inserted into the cavity is engaged by the lock and is held so as not to come out of the cavity. Thereafter, a mating tab terminal is inserted into the cavity from the front through the tab insertion hole and is connected electrically with the terminal fitting. A misaligned tab terminal slides along the guide surface and is guided smoothly into the cavity.

The narrowed portion of the lock that overlaps the guide surface enables the mold for forming the lock to have a narrow leading end. The mold-removal hole is at a part of the front wall of the cavity where the guide surface is formed and has a shape conforming to the outer periphery of the narrowed portion. Thus, an area of the guide surface cut off by the mold-removal hole can be made smaller as much as the narrowed portion is narrowed. Accordingly, the guide surface for the tab terminal is as large as possible, and the tab terminal can be guided smoothly into the tab insertion hole.

The narrowed portions preferably are at opposite sides of the lock, and the mold-removal hole preferably defines an M-shape. The widths of portions of the mold-removal hole that correspond to the narrowed portions can be made smaller by providing the narrowed portions at the opposite widthwise sides of the lock. Thus, the tab terminal can be guided more satisfactorily since the part of the guide surface interrupted by the mold-removal hole is divided into two portions, and the widths of the individual interrupted portions is small.

The bottoms of the opposite ends of the substantially M-shaped portion of the mold-removal hole and the end of a portion between the two narrowed portions are at substantially the same height.

Portions of the guide surface at a recessed midpoint of the M-shaped portion of the mold-removal hole and portions thereof at the opposite bottom ends of the M-shaped portion are substantially aligned.

A projection on the terminal fitting slides in contact with surfaces between the two narrowed portions to guide the terminal fitting into the cavity. Thus, widthwise shaking of the terminal fitting is suppressed.

The sliding-contact surfaces preferably are inclined inversely of each other and converge. Accordingly, the terminal fitting is guided to a widthwise center position to suppress the widthwise shaking, and the insertion of the terminal fitting is easier.

The lock preferably is engageable with a rear end of the projection.

The construction of the terminal fitting can be simplified by using the projection as the engaging portion that is engageable with the lock.

The leading end of the narrowed portion preferably reaches the tab insertion hole with respect to height direction, and the narrowed portion may be substantially at the widthwise center of the lock.

The narrowed portion of the lock may have a height that reaches both the guide surface and the tab insertion hole. Thus, the mold-removal hole communicates with the tab insertion hole. The narrowed portion may be substantially at the widthwise center of the lock, and the edge of the mold-removal hole along the outer periphery of the narrowed portion is more inward, thereby making the guide surface larger.

A portion of the lock that engages the terminal fitting preferably is more toward the base end of the lock than the narrowed portion(s).

When the terminal fitting is inserted into the cavity, the projection slides in contact with the sliding-contact surfaces between the narrowed portions of the lock. Thus, widthwise shaking of the terminal fitting is suppressed and the insertion operability of the terminal fitting is better.

A large shear area is more toward the base of the lock end than the narrowed portion. Thus, a force to lock the terminal fitting can be larger.

The lock preferably includes a resiliently deformable arm and a locking section that engages the terminal fitting inserted into the cavity and having the overlapping part. The arm is formed before the locking section and has a groove for receiving a projection on the terminal fitting. The projection inserted in the groove is engageable with the locking section.

The projection presses the locking section while the terminal fitting is being inserted into the cavity to deform the arm. The arm is restored resiliently when the terminal fitting is inserted to a proper depth, and the projection is inserted into the groove to be engaged by the locking section. In this way, the terminal fitting is held so as not to come out of the cavity.

The arm is formed with the groove and the projection inserted into the groove is engaged with the locking section. Thus, the distance between the leading end of the locking section with respect to height direction and the tab insertion hole can be made longer by the height of the groove while ensuring a sufficient engaged area of the locking section with the projection. Additionally the distance between the mold-removal hole and the tab insertion hole can be made longer, and a large area can be ensured for the guide surface with which the tab terminal is to be held in sliding contact. Therefore, the tab terminal can be guided more smoothly to the tab insertion hole.

The invention also relates to a terminal fitting for the above-described connector. The terminal fitting has a projection for sliding contact with the surfaces between the two narrowed portions to guide the terminal fitting into the cavity. The construction of the terminal fitting can be simplified by using the projection as the engaging portion engageable with the lock.

The invention also is directed to a disengagement jig to be used for the above-described connector for withdrawing the terminal fitting from the connector or the cavity. The jig comprises a shaft that is insertable into the mold-removal hole. The jig can act on and resiliently deform the lock. A reinforcing rib extends substantially along the longitudinal direction of the shaft and is insertable into the portion of the mold-removal hole corresponding to the narrowed portion. Thus, the jig is strong even if the shaft is narrowed to cope with the miniaturization of the connector.

The disengagement jig may have a restricting portion for engaging the housing and restricting an inserted depth of the disengagement jig into the mold-removal hole to a position reached before the disengagement jig interferes with the lock. Accordingly, the disengagement jig will not get stuck in the lock and damage can be avoided.

The disengagement jig is used in a connector with a terminal fitting that includes a resilient contact piece for contacting a tab terminal. An erroneous-insertion restricting portion restricts an inserted depth of the disengagement jig into the tab insertion hole to a position reached before the disengagement jig interferes with the resilient contact piece.

The restricting portion also is the erroneous-insertion restricting portion that restricts an inserted depth of the disengagement jig into the tab insertion hole to a position reached before the disengagement jig interferes with the resilient contact piece. Thus, the jig is simplified.

Excessive deformation preventing portions may be provided for engaging the locks and preventing the locks from being excessively deformed. An engaging surface of each lock with the corresponding excessive deformation-preventing portion is retracted from a leading end surface of the lock with respect to the deforming direction. Each excessive deformation-preventing portion overlaps a portion of the deformation space into which the lock deforms.

The excessive deformation preventing portions can be closer to the corresponding locks by as much as the engaging surfaces are retracted from the leading end surfaces. Thus, the connector can be made smaller by a corresponding amount.

An engageable surface of each excessive deformation-preventing portion is to be engaged with the engaging surface of the corresponding lock. Thus, a pushing force that acts on the excessive deformation-preventing portion when the engaging surface engages the engageable surface can be alleviated. This eliminates the need for a special consideration to enhance the strength of the excessive deformation preventing portions, thereby improving a degree of freedom in the connector designing.

The cavities preferably are at a plurality of stages along the deforming direction of the locks. The locks, the deformation spaces and the excessive deformation preventing portions are formed by cutting partition walls that partition the cavities that are adjacent along the deforming direction of the locks. The deformation spaces are formed to communicate with the cavities adjacent along the deforming direction of the locks, and each excessive deformation-preventing portion can prevent a loose movement of the terminal fitting by engaging the terminal fitting inserted into the adjacent cavity.

A connector may be miniaturized by forming the locks, the deformation spaces and the excessive deformation preventing portions by cutting the partition walls, and the adjacent cavities of such a connector may communicate with the deformation spaces. Each excessive deformation-preventing portion in such a connector is engageable with the terminal fitting inserted into the adjacent cavity, and the terminal fitting is prevented from making a loose movement to enter the deformation space.

The locks, the deformation spaces and the excessive deformation preventing portions preferably are formed by cutting an outer wall of the connector housing. Thus, the deformation spaces communicate with outside. Each excessive deformation-preventing portion can protect the corresponding lock by being provided to cover an outer surface of the locking portion.

The deformation spaces may communicate with the outside to expose the locks. However, the excessive deformation preventing portions substantially prevent external matter from interfering with the locks from the outside, thereby preventing the locks from being damaged.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of a female connector in accordance with the invention is described with reference to FIGS. 1 to 17. The female connector illustrated in this embodiment has a housing 20, terminal fittings 10 accommodated in the housing 20, and a retainer 50 for locking the terminal fittings 10 in the housing 20. This female connector is connectable with an unillustrated mating male connector. In the following description, an inserting direction ID of the terminal fittings 10 into the housing 20 is referred to as a forward direction and reference is made to all the figures except FIGS. 3, 5, 7 and 9 concerning the vertical direction.

Figure 4:
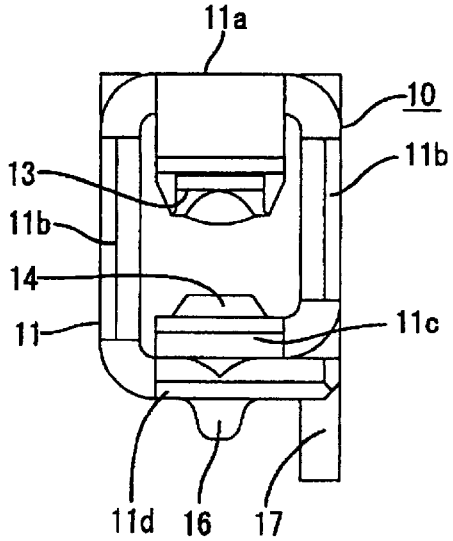
FIG. 4 is a front view of a terminal fitting.
Figure 6:
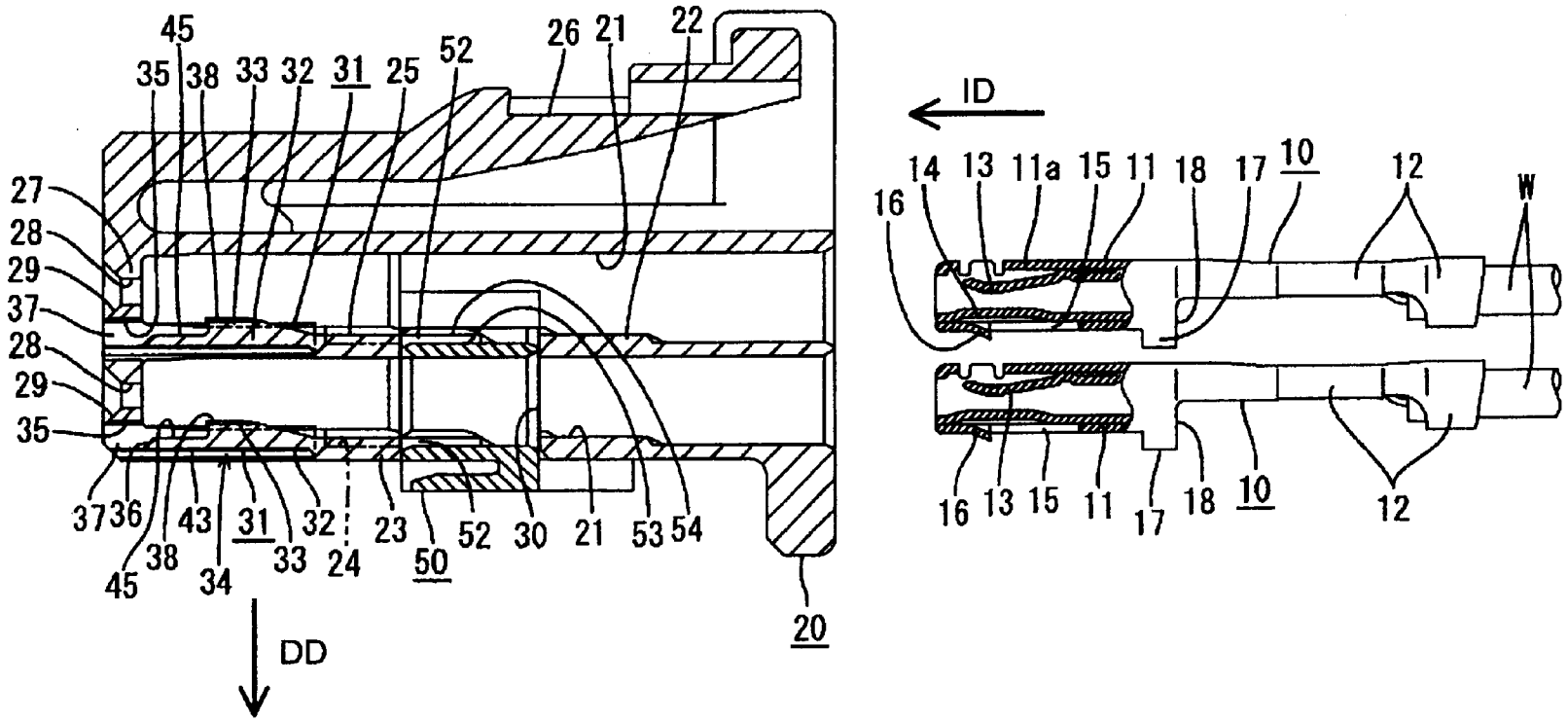
FIG. 6 is a side view in section showing the housing in which a retainer is mounted at a partial locking position, and the terminal fittings.

Each terminal fitting 10 is formed from a metallic plate that is worked by a press into the shape shown in FIG. 6. The terminal fitting has a main body 11 connectable with a tab terminal in the mating male connector, and a barrel 12 that is crimped, bent or folded into connection with an end of a wire W. As shown in FIG. 4, the main body 11 has a base plate 11*a* that extends in forward and backward directions and side plates 11*b* that extend from the opposite lateral edges of the base plate 11*a*. Projecting plates 11*c* and 11*d* project from the ends of the side plates 11*b* remote from the base plate 11*a* and are bent inwardly to be placed at least partly over one another. Thus, the main body 11 defines a box shape with open front and rear ends. A resilient contact piece 13 projects from the rear end of the base plate 11*a* and extends forward substantially along the base plate 11*a* inside the main body 11, as shown in FIG. 6. The resilient contact piece 13 is supported at one end and has its front portion formed in a bent substantially triangular shape spaced from the base plate 11*a*. Thus, the resilient contact piece 13 can be brought resiliently into contact with the tab terminal inserted into the main body 11 from the front. A portion of the inner projecting plate 11*c* that faces the resilient contact piece 13 is embossed or bent to define a bulge 14 for increasing contact pressure with the tab terminal.

Figure 5:
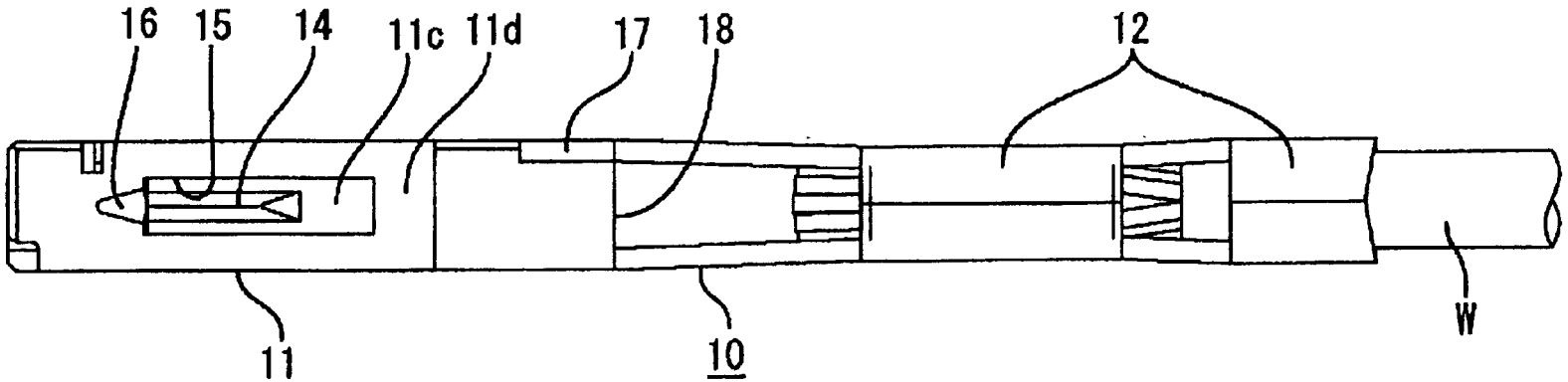
FIG. 5 is a bottom view of the terminal fitting.

A substantially rectangular escaping hole 15 is formed substantially in the center of the outer projecting plate 11*d*, as shown in FIG. 5. The escaping hole 15 preferably is formed by cutting, and has a length of more than about half, and preferably about ⅔ the length of the outer projecting plate 11*d*. A portion of the outer projecting plate 11*d* forward of the escaping hole 15 is embossed or bent to define an outwardly directed projection 16. The projection 16 is tapered toward its front end such that the width of the projection 16 gradually decreases when viewed from below. Thus, the projection 16 has a substantially triangular or trapezoidal shape with a vertex substantially at the widthwise center, as shown in FIG. 4. The projection 16 guides the insertion of the terminal fitting 10, as described in detail later (see FIG. 9). A stabilizer 17 projects down along the side plate 11*b* at the rear end of the outer projecting plate 11*d*, and a jaw 18 is provided at the rear bottom or lateral end of the main body 11. The rear surfaces of the jaw 18 and the stabilizer 17 are substantially flush with each other along the inserting direction ID.

Figure 1:
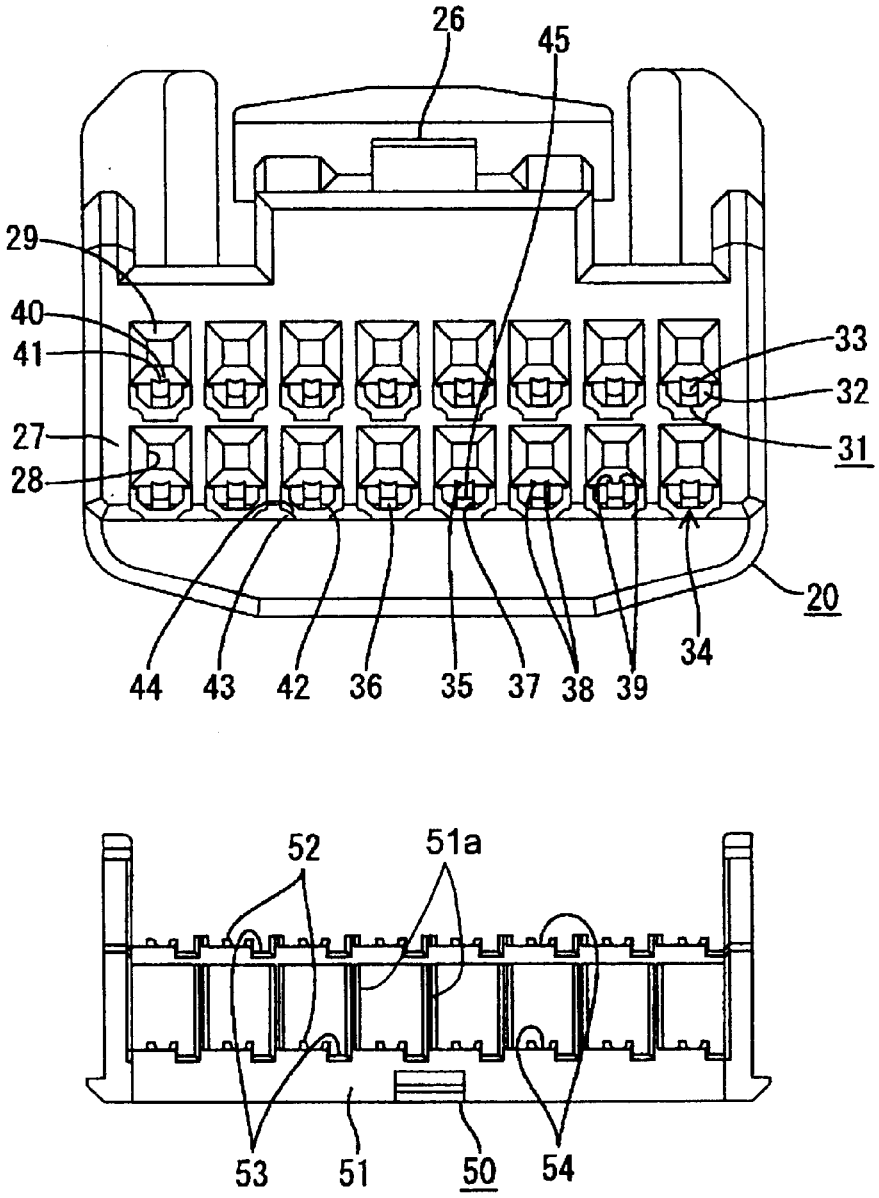
FIG. 1 is a front view of a housing according to a first embodiment of the invention.
Figure 2:
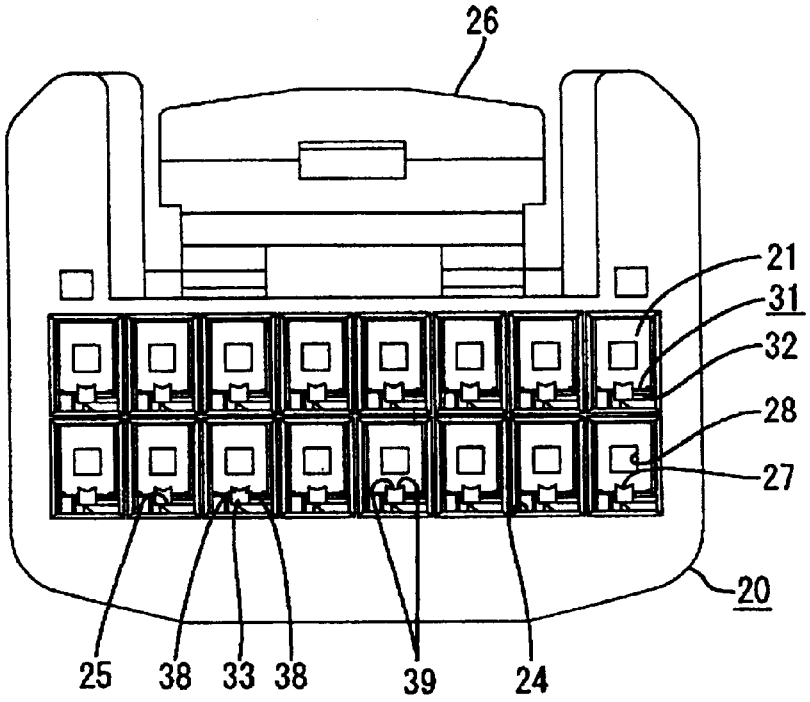
FIG. 2 is a rear view of the housing.
Figure 7:
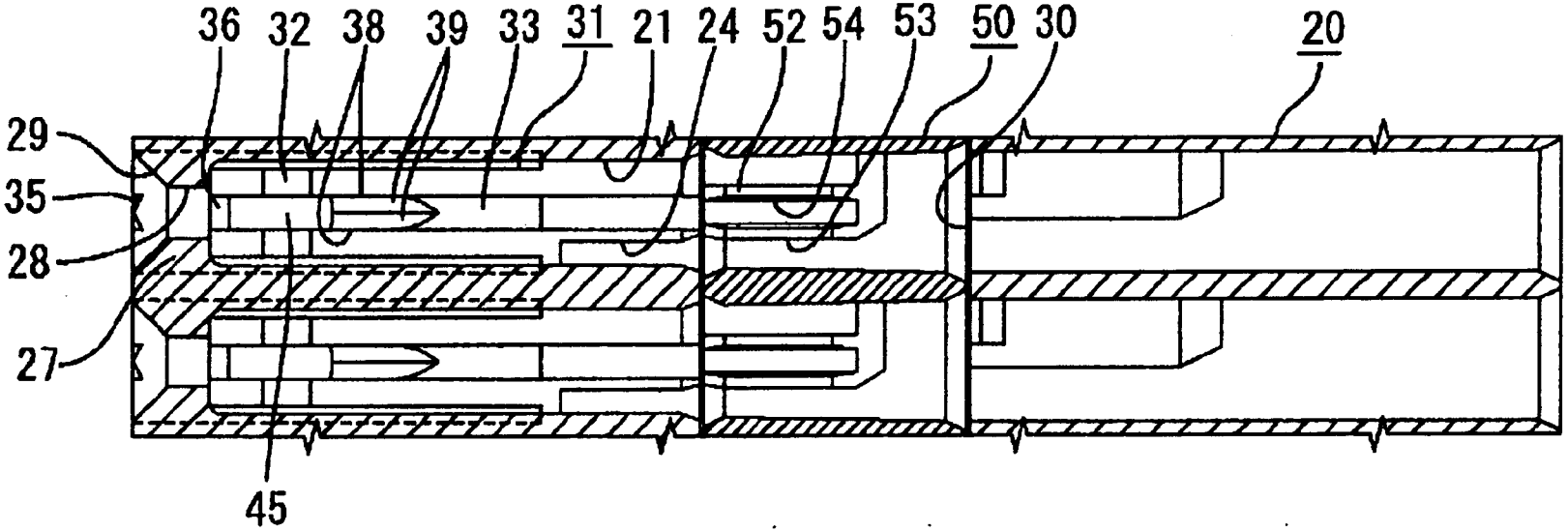
FIG. 7 is a plan view in section of the housing.

The housing 20 is made e.g. of a synthetic resin and, as shown in FIG. 1, has a substantially block shape. Cavities 21 are formed in the housing 20 and are arranged along the widthwise direction at upper and lower stages. The cavities 21 are configured to receive the terminal fittings 10 from behind. Partition walls 22 partition the cavities 21 that are vertically adjacent to each other. The partition walls 22 form the bottom walls of the cavities 21 at the upper stage and the upper walls of the cavities 21 at the lower stage. Locks 31 are formed on the partition walls 22 and on a bottom wall 23. The bottom wall 23 forms the bottoms of the cavities 21 at the lower stage and is an outer wall of the housing 20. The locks 31 are resiliently deflectable and are configured to engage the terminal fittings 10 inserted into the respective cavities 21, as described in detail later. A stabilizer-inserting groove 24 is formed at one side of the bottom surface of each cavity 21, and opens back toward an inserting side of the terminal fitting 10 into the cavity 21, as shown in FIGS. 2 and 7. Thus, the stabilizer 17 of the terminal fitting 10 is insertable into the stabilizer-inserting groove 24. Further, a projection-inserting groove 25 is formed at substantially the widthwise center of the bottom surface of each cavity 21 for permitting insertion of the projection 16 of the terminal fitting 10. A lock arm 26 projects from the upper surface of the housing 20 for locking the female connector and the mating male connector together.

Tab insertion holes 28 are formed in front walls 27 of the cavities 21, as shown in FIGS. 1 and 6, for permitting the entrance of the tab terminals T into the cavities 21. Guide surfaces 29 are formed around the front edges of the tab insertion holes 28 for guiding the tab terminals T into the tab insertion holes 28. The guide surfaces 29 converge toward the inner surfaces of the tab insertion holes 28, and the width and height of the guide surfaces 29 at the outermost side preferably are larger than or equal to the width and height of the cavities 21 and are substantially equal to each other.

Figure 3:
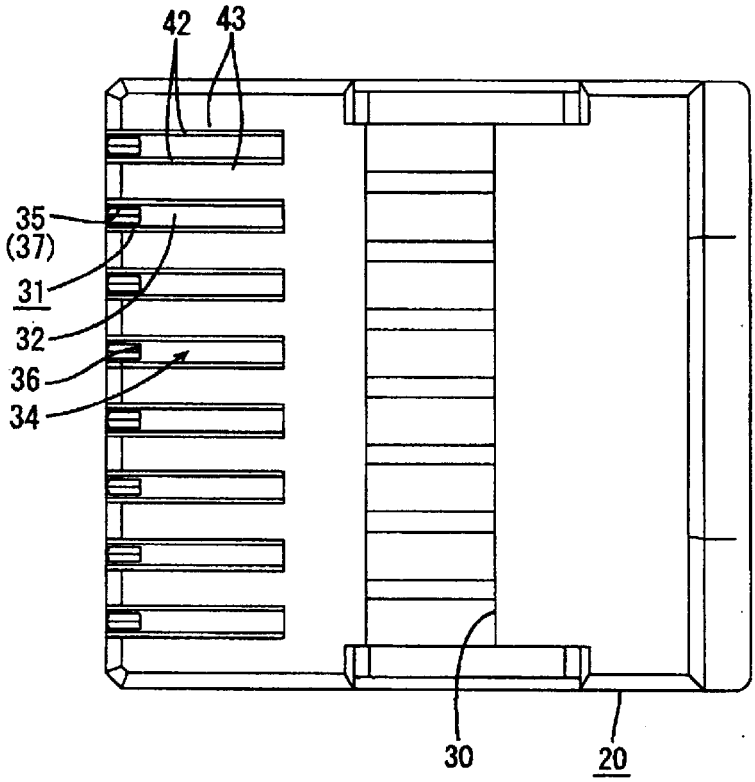
FIG. 3 is a bottom view of the housing.

A retainer mount hole 30 is formed in the bottom surface of the housing 20, as shown in FIGS. 3 and 6, and is configured to receive the retainer 50 from below. The retainer mount hole 30 is substantially at a center position of the housing 20 with respect to forward and backward directions and communicates with all the cavities 21. Thus, the retainer mount hole 30 divides the partition walls 22 and the bottom wall 23 into front and rear sections. As shown in FIGS. 1 and 6, the retainer 50 includes a lattice-shaped main portion 51 with partition walls 51*a* at positions substantially corresponding to the side walls of the respective cavities 21 of the housing 20. Locking projections 52 project up at substantially middle positions between the adjacent partition walls 51*a* of the main portion 51 and are engageable with the respective jaws 18 of the terminal fittings 10. A stabilizer-inserting recess 53 is formed before or near each locking projection 52 in FIG. 7, and comes substantially into communication with the stabilizer-inserting groove 24 of the housing 20 to permit the insertion of the projection 16 of the terminal fitting 10. A projection-insertion recess 54 is formed in substantially a widthwise center of each locking projection 52 for permitting the insertion of the projection 16. The retainer 50 is vertically movable between a partial locking position (see FIG. 6) and a full locking position (see FIG. 11). The locking projections 52 are retracted from the cavities 21 when the retainer 50 is at the partial locking position. Thus, the terminal fittings 10 can be inserted into the cavities 21 by aligning the stabilizer-inserting recesses 53 and the projection-insertion recesses 54 with the stabilizer-inserting grooves 24 and the projection-inserting grooves 25. However, the locking projections 52 enter the cavities 21 to engage the jaws 18 and lock the terminal fittings 10 in the cavities 21 when the retainer 50 is at the full locking position.

The locks 31 are provided at the bottom surfaces of the respective cavities 21, as shown in FIG. 6, and are formed by cutting front portions of the partition walls 22 and the bottom wall 23 before the retainer mount hole 30 into a specified shape. Each lock 31 includes an arm 32 supported at both front and rear ends, and a locking section 33 formed on the upper surface of the arm 32 for engaging the projection 16 of the terminal fitting 10.

Figure 8:
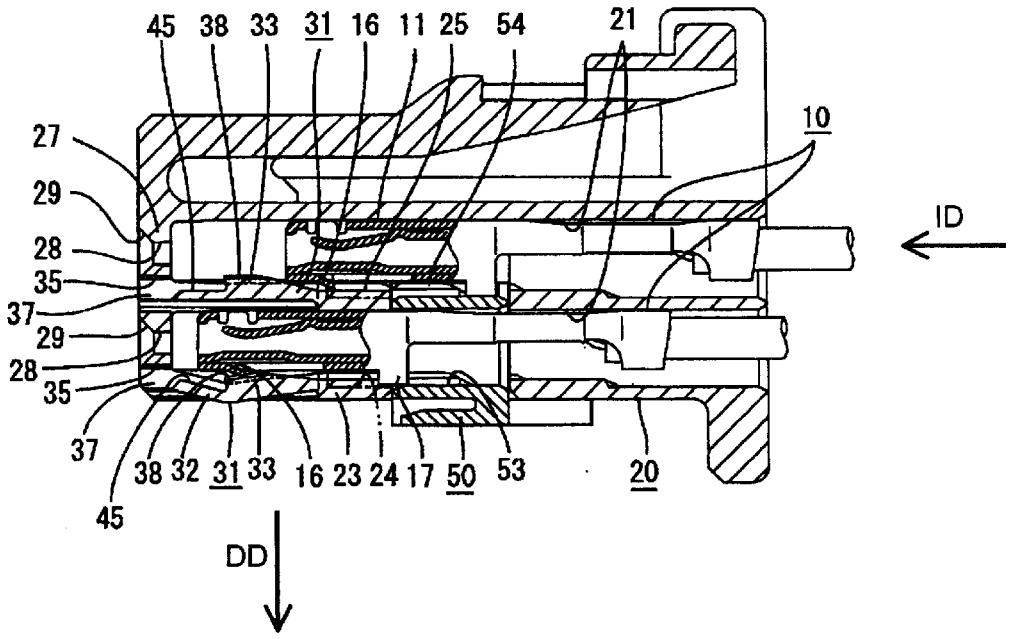
FIG. 8 is a side view in section showing intermediate stages of the insertion of the terminal fittings.

The arm 32 extends forward and backward, as shown in FIG. 7, and has its rear end coupled to the partition wall 22 or bottom wall 23 at a position immediately before or near the stabilizer-inserting groove 24 and has its front end coupled to the front wall 27. Thus, the arm 32 is a beam supported at both ends, and has high strength. The arm 32 is slightly narrower than the cavities 21, and is resiliently deformable with the front and rear coupling portions as deformation supporting points. Accordingly, the arm 32 is deflected in the deformation direction DD into a deformation permitting space 34 formed below. The arm 32 is deformed resiliently into a substantially arch shape in which a middle portion thereof with respect to forward and backward directions is at a bottommost position, as shown in FIG. 8, and traces of displacement of the respective parts of the arm 32 resulting from the resilient deformation are substantially straight, vertical and normal to the insertion direction ID.

The locking section 33 projects into the cavity 32 from the upper surface of the arm 32, as shown in FIG. 6, and the height and width of the locking section 33 are set to engage the projection 16 of the terminal fitting 10 and sections of the front end of the escaping hole 15 at the opposite sides of the projection 16. The projecting end of the projection 16 is engageable with the base end of the front surface of the locking section 33 (see FIG. 10). The locking section 33 is located substantially at the widthwise center of the arm 32 and extends from the rear end of the arm 32 to a position slightly more forward than the longitudinal center, as shown in FIG. 7. The front surface of the locking section 33 is at an acute angle to the inserting direction ID of the terminal fitting 10, and hence forms an overhang. The rear surface of the locking section 33 is slanted such that the terminal fitting 10 being inserted into the cavity 21 pushes the arm 32 and deforms the arm 32 resiliently.

The upper surface of the arm 32 forms the bottom surface of the cavity 21 and supports the terminal fitting 10 inserted into the cavity 21 from below. As shown in FIGS. 6 and 7, the upper surface of the arm 32 before the locking section 33 is sloped up to the front, and the ceiling surface of the cavity 21 that faces these slanted surfaces is slanted or recessed with substantially the same inclination. The front end of the cavity 21 is narrowed by these slanted surfaces to a height that permits insertion of the front end of the terminal fitting 10. Further, rearward portions of the cavity 21 have a height to loosely receive the terminal fitting 10.

Figure 12:
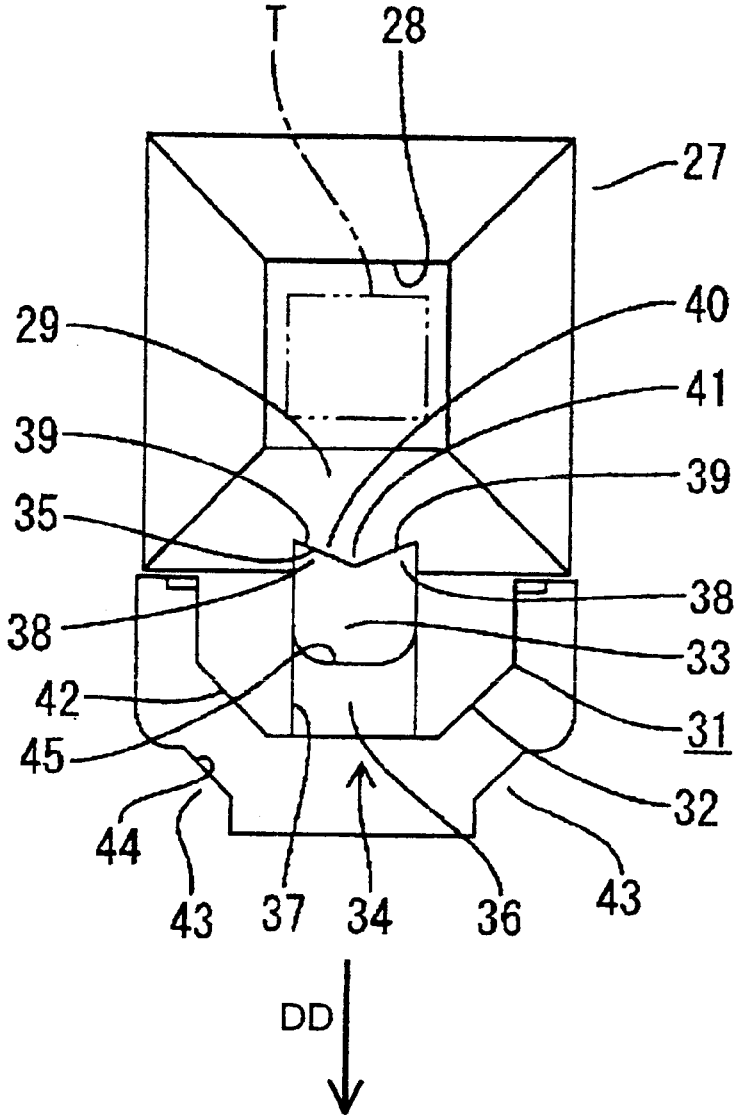
FIG. 12 is an enlarged front view showing a state where a tab terminal is properly inserted into a tab insertion hole at an upper stage.

A first mold-removal hole 35 extends from a position aligned with the front surface of the locking section 33 at the widthwise center of the arm 32. The first mold-removal hole 35 is formed in the arm 32 and the front wall 27 to open forward so that a mold pin for forming the locking section 33 can be removed forward when the housing 20 is molded. As shown in FIGS. 6 and 12, a portion of the first mold-removal hole 35 recesses the arm 32 and defines a groove 45. The projection 16 of the terminal fitting 10 inserted to a proper depth into the cavity 21 is inserted into the groove 45 (see FIG. 10) and has its projecting end engage the front surface of the locking section 33. A disengagement jig 60 can be inserted into the first mold-removal hole 35 from outside and can forcibly deform the arm 32 down. A guide surface 36 is formed at substantially the widthwise center of the front end of the arm 32 and is sloped up along the inserting direction of the disengagement jig 60 to guide the disengagement jig 60 back in the first mold-removal hole 35. The front wall 27 and the arm 32 also have a second mold-removal hole 37 formed by removing a mold for forming the guide surface 36. The second mold-removal hole 37 communicates with the first mold-removal hole 35. The front end of the arm 32 is forked into two side portions by the mold-removal holes 35, 37, and the two side portions are coupled to the front wall 27. Accordingly, the front of the arm 32 is coupled to the front wall 27 at two positions while the rear of the arm 32 is coupled to the partition wall 22 (bottom wall 23) over the entire width of the arm 32 at one position to support the arm 32 at three positions.

The locking section 33 projects into the cavity 21 a sufficient distance in the height direction to overlap the guide surface 29 of the front wall 27, as shown in FIG. 12. More particularly, the upper end of the locking section 33 is higher than the lower surface of the guide surface 29. Thus, the guide surface 29 is cut out along the outer peripheries of the front wall 27 and the overlapping part of the locking section 33 by the first mold-removal hole 35 formed by removing the mold for forming the locking section 33.

Narrowed portions 38 are formed at the opposite widthwise sides of the upper end of the locking section 33 and become gradually narrower toward the top, as shown in FIG. 12. The bottom ends of the two narrowed portions 38 align substantially with the bottom end of the guide surface 29, and a projecting height thereof is about ¼ of the height of the bottom part of the guide surface 29. The bottom of each narrowed portion 38 is preferably half as wide as the locking section 33. The narrowed portions 38 are substantially in the form of a right triangle and are transversely symmetrical with each other so that their oblique surfaces 39 substantially face each other. The two oblique surfaces 39 connect with each other to form a substantially V-shape when viewed from the front. In other words, the oblique surfaces 39 are inclined inversely and taper inwardly towards the middle of the locking section 33. The outer surface of the projection 16 of the terminal fitting 10 can be brought into sliding contact with the oblique surfaces 39 to guide the terminal fitting 10 toward the widthwise center and to suppress widthwise shaking of the terminal fitting 10 (see FIG. 9). As shown in FIG. 7, the narrowed portions 38 preferably are about half as long as the locking section 33, and extend back from the front end of the locking section 33. The rear ends of the narrowed portions 38 gradually decrease in height toward the back.

Figure 10:
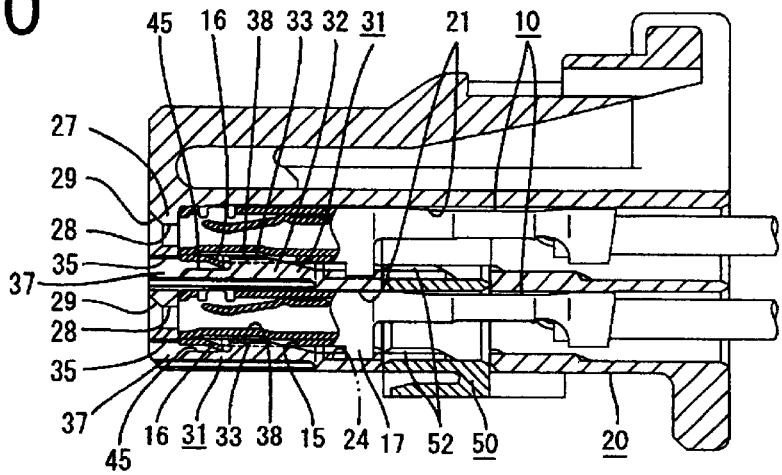
FIG. 10 is a side view in section showing a state where the terminal fittings are inserted to a proper depth.

The narrowed portions 38 escape into the escaping hole 15 of the terminal fitting 10 when the lock 31 is engaged with the terminal fitting 10 and engage with the portions of the front edge of the escaping hole 15 at the opposite sides of the projection 16 (see FIG. 10). At this time, the projection 16 engages substantially the entire area of the locking section 33 excluding the two narrowed portions 38. Here, a shear area of the lock 31 engaged with the terminal fitting 10 is such that the area of the locking section 33 engaged with the projection 16 is larger than the areas of the narrowed portions 38 engaged with the front edge of the escaping hole 15. It should be noted that the shear area of the locking portion 31 engaged with the terminal fitting 10 is proportional to a force to lock the terminal fitting 10.

A part of the first mold-removal hole 35 that cuts out the guide surface 29 is substantially M-shaped, and is aligned longitudinally with the outer peripheries of the narrowed portions 38, as shown in FIG. 12. Thus, the first mold removal hole 35 comprises a trapezoidal shape that has a substantially rectangular section in which one side surface converges inwardly. The opposite ends of the M-shaped portion of the first mold-removal hole 35 are at substantially the same height as the bottom of the portion of the first mold-removal hole 35 located between the two narrowed portions 38. Thus, an isosceles-triangular jutting portion 40 is on an upper peripheral edge of the first mold removal hole 35 in a portion of the front wall 27 between the two narrowed portions 38, and the guide surface 29 extends to this triangular portion. An auxiliary guide surface 41 is formed on the front of the jutting portion 40 and has an inclination substantially continuous with the guide surface 29. The bottom of the auxiliary guide surface 41 substantially aligns with the bottom end of the guide surface 29 and the width thereof gradually increases at upper positions toward the tab insertion hole 28. Two oblique surfaces of the jutting portion 40 substantially coincide with the oblique surfaces 39 of the narrowed portions 38 when viewed from the front, as shown in FIG. 12.

Two slanted surfaces 42 are formed at the opposite bottom sides of the arm 32 and slope up to the outer widthwise sides over substantially the entire length of the arm 32. Two excessive deformation-preventing portions 43 bulge in the form of cut edges at portions of the partition wall 22 or the bottom wall 23 facing the slanted surfaces 42 and have slanted receiving surfaces 44 with substantially the same inclinations as the slanted surfaces 42. The receiving surfaces 44 of the excessive deformation preventing portions 43 are parallel to and face the slanted surfaces 42 and hence are engageable with the slanted surfaces 42 of the arm 32 to prevent the arm 32 from deforming beyond its resilient or elastic limit. The excessive deformation preventing portions 43 extend longitudinally along the arm 32 and are coupled to the front wall 27 of the cavity 21, as shown in FIG. 3. The bottom surface **32*b* of the deformed arm 32 substantially aligns with the bottom of the deformation permitting space 34 when the slanted surfaces 42 engage the receiving surfaces 42**.

Figure 18:
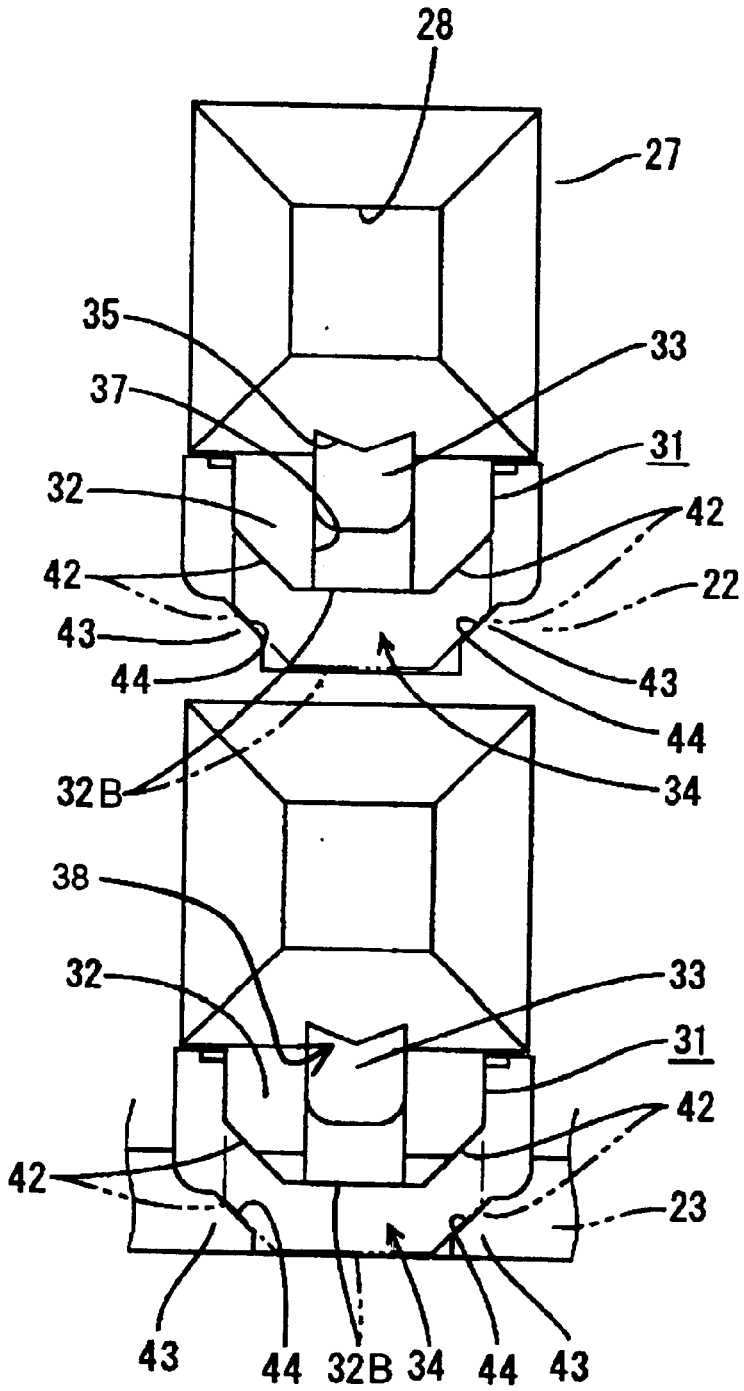
FIG. 18 is an enlarged front view showing a state where an excessive deformation of the locking portion is prevented.

The two excessive deformation-preventing portions 43 are coupled to the front wall 27 of the cavity 21, as shown in FIGS. 3 and 6, and extend back to cover substantially the entire length of the arm 32. As shown in FIG. 18, the excessive deformation-preventing portions 43 are substantially transversely symmetrical with each other and the inwardly bulging ends thereof are set to reach positions more inward by a specified distance than the positions of the inner side surfaces of the cavity 21 and slightly more outward than the inner ends of the slanted surfaces 42. Specifically, a distance between the bulging ends of the two excessive deformation-preventing portions 43 is sufficiently shorter than the width of the cavity 21, and the opening width of the deformation permitting space 34 is made smaller toward the bottom as much as the two excessive deformation-preventing portions 43 bulge toward one another. Further, the slanted receiving surfaces 44 have a length that is slightly longer than half the length of the slanted surfaces 42. The bottom ends of the excessive deformation-preventing portions 43 substantially align with the bottom end of the deformation permitting space 34. Thus, substantially the entire areas of the two excessive deformation preventing portions 43 are arranged to overlap a portion of the deformation permitting space 34 for letting the bottom end surface **32*b* of the arm 32 escape with respect to height direction (deforming direction DD of the lock 31**).

As shown in FIG. 6, the bottom surfaces of the excessive deformation preventing portions 43 corresponding to the cavities 21 at the upper stage face the cavities 21 at the lower stage and form the ceiling surface of the cavities 21 at the lower stage. Accordingly, the slanted surfaces sloped down to the front are formed on the bottom surfaces of the excessive deformation preventing portions 43. The upper surface of the terminal fitting 10 inserted into the cavity 21 at the lower stage can be held substantially in sliding contact the slanted surfaces. Thus, even if the terminal fitting 10 being inserted into the cavity 21 at the lower stage moves loosely up, the bottom surfaces of the two excessive deformation-preventing portions 43 engage the terminal fitting 10. Accordingly vertical shaking of the terminal fitting 10 can be suppressed and the entrance of the terminal fitting 10 at the lower stage into the deformation permitting space 34 at the upper stage can be prevented.

As shown in FIG. 3, the excessive deformation preventing portions 43 corresponding to the cavities 21 at the lower stage are arranged to cover the opposite sides of the bottom surfaces of the arms 32 exposed to the outside below by the deformation permitting spaces 34. Thus, the corresponding excessive deformation-preventing portions 43 reduce an area of the outer surface of each arm 32 exposed to the outside. This makes it difficult for external matter to collide with the arms 32 from outside and, therefore, the lock 31 can be protected.

Figure 14:
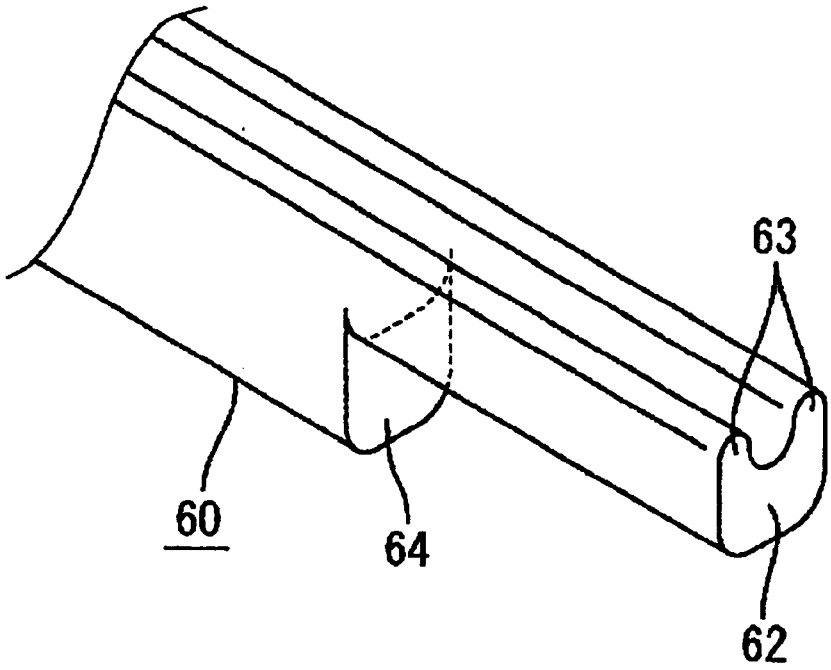
FIG. 14 is an enlarged perspective view of a disengagement jig.
Figure 15:
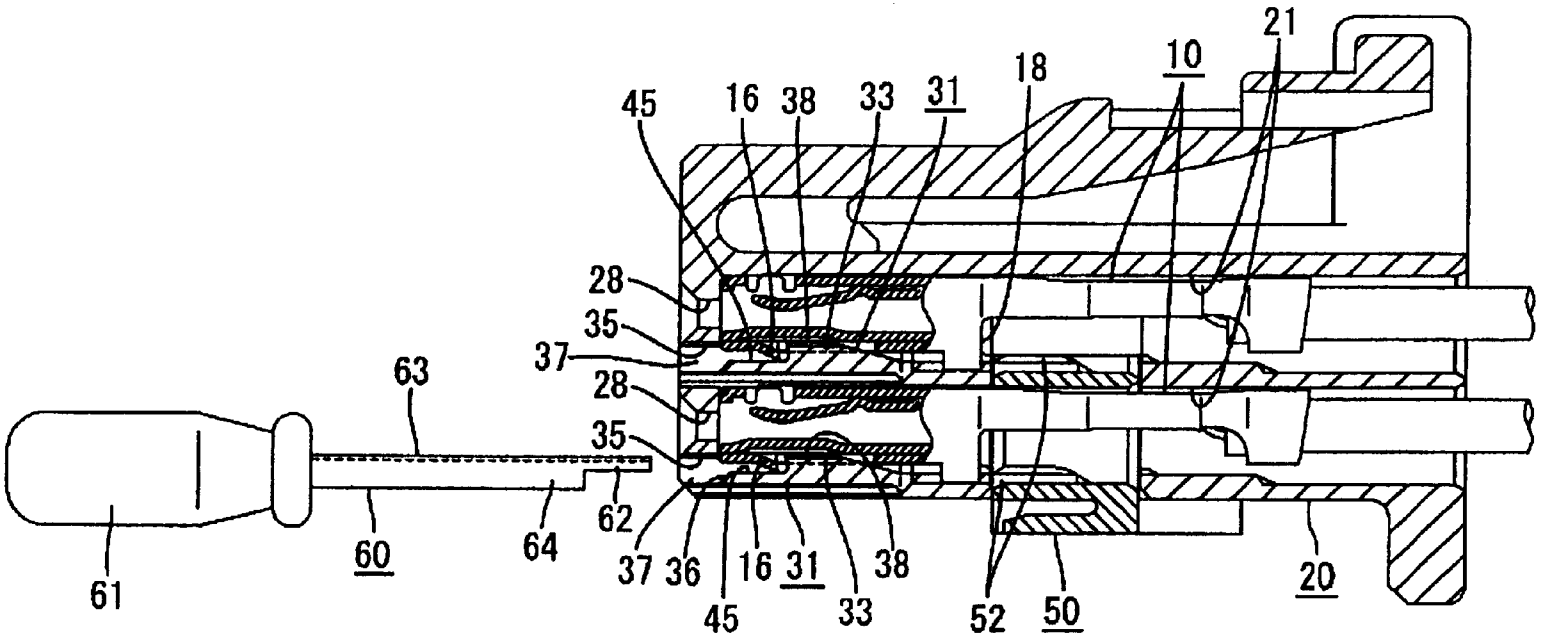
FIG. 15 is a side view in section showing a state before the retainer is moved to the partial locking position and the disengagement jig is inserted.

A disengagement jig 60 that disengages the lock 31 is shown in FIGS. 14 and 15. The disengagement jig 60 has a rectangular shaft 62 that projects forward from a grip 61 that can be manipulated by an operator. Reinforcing ribs 63 project up from opposite sides of the shaft 62 and extend longitudinally over substantially the entire length of the shaft 62 to increase the strength of the shaft 62. The reinforcing ribs 63 are dimensioned to fit into portions of the first mold-removal holes 35 of the housing 20 corresponding to the two narrowed portions 38 of the lock 31. The front end of the disengagement jig 60 is substantially U-shaped when viewed from front. A restricting portion 64 is formed on the bottom surface of the shaft 62 and has the same width as the shaft 62. The front end of the restricting portion 64 is more backward than the front end of the shaft 62 and the reinforcing ribs 63.

To disengage the lock 31, the shaft 62 is inserted into the first mold-removal hole 35 and the restricting portion 64 is inserted into the second mold-removal hole 37. At this time, the reinforcing ribs 63 are inserted into portions of the first mold-removal hole 35 corresponding to the narrowed portions 38 of the lock 31, and have their outer circumferential surfaces held in sliding contact with the inner circumferential surface of the mold-removal hole 35 to suppress widthwise shaking of the shaft 62. The inner surface at the backside of the first mold-removal hole 35 then is pressed down by the leading end of the shaft 62 to deform the arm 32. The restricting portion 64 engages the guide surface 36 at substantially the widthwise center of the arm 32 before the shaft 62 strikes against the locking section 33. Thus, the disengagement jig 60 is prevented from any further insertion into the first and second mold-removal holes 35, 37 (see FIG. 16). On the other hand, the disengagement jig 60 may be inserted erroneously into the tab insertion hole 28 in an effort to disengage the lock 31. In such a case, the restricting portion 64 engages the front surface of the front wall 27 before the leading end of the shaft 62 enters the cavity 21 to interfere with the resilient contact piece 13 of the terminal fitting 10. Thus, the disengagement jig 60 is prevented from any further insertion into the tab insertion hole 28 (see FIG. 17). Accordingly, the restricting portion 64 prevents the disengagement jig 60 from striking against the lock 31 and prevents an erroneous insertion of the disengagement jig 60 into the tab insertion hole 28. A distance between the front of the shaft 62 and the front of the restricting portion 64 is less than a distance between the front of the locking section 33 and the guide surface 36 and less than a distance between the front of the resilient contact piece 13 and the front surface of the front wall 27. It should be noted that the distance between the front surface of the locking section 33 and the guide surface 36 approximately equals the distance between the front end of the resilient contact piece 13 and the front surface of the front wall 27.

Figure 9:
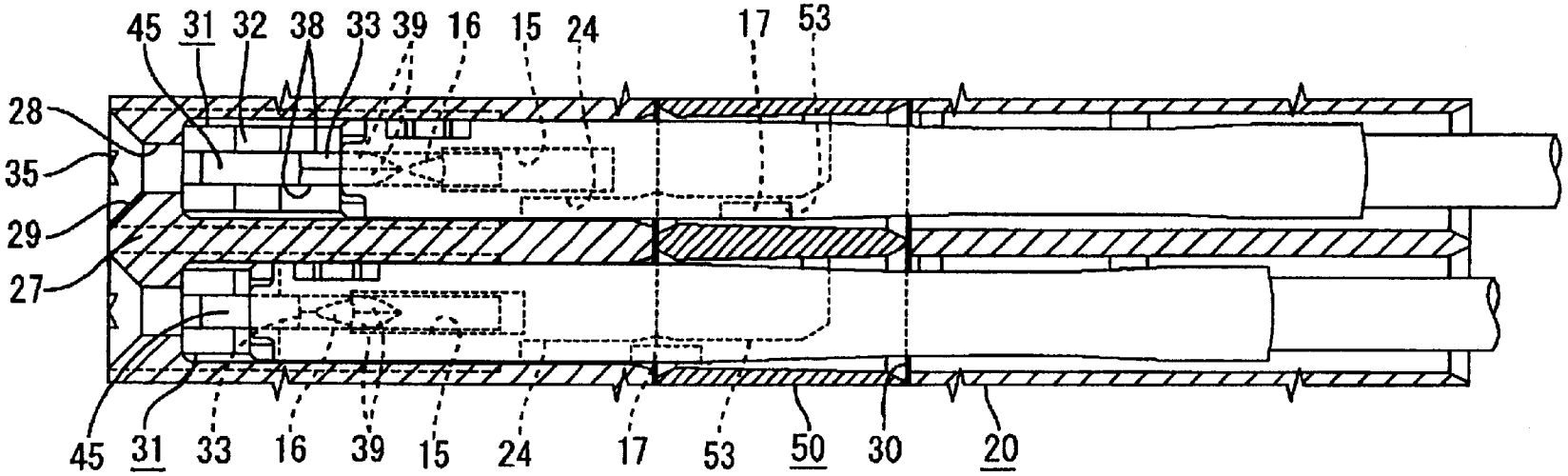
FIG. 9 is a plan view in section showing intermediate stages of the insertion of the terminal fittings.

As shown in FIG. 6, the terminal fittings 10 are inserted into the respective cavities 21 in the inserting direction ID with the retainer 50 mounted at the partial locking position in the housing 20. The insertion of each terminal fitting 10 into the cavity 21 is guided smoothly by the sliding contact of the stabilizer 17 with the stabilizer-inserting groove 24 and the stabilizer-inserting recess 53 and the sliding contact of the projection 16 with the projection-inserting groove 25 and the projection-inserting recess 54 (see FIG. 9). When the terminal fitting 10 is inserted to a specified depth, the front bottom end of the main body 11 engages the rear surface of the locking section 33 of the lock 31, as shown in FIGS. 8 and 9. As the terminal fitting 10 is inserted further, the arm 32 is deformed gradually and resiliently down in the deformation direction DD, and the terminal fitting 10 is guided by the inclination of the locking section 33. The terminal fitting 10 is inserted further so that the projection 16 moves between the narrowed portions 38 and the bottom end thereof presses the widthwise center of the locking section 33 between the narrowed portions 38, thereby further resiliently deforming the arm 32. During this process, the projection 16 is inserted smoothly between the narrowed portions 38 due to the tapered front end of the projection 16. Further, the terminal fitting 10 is guided to the widthwise center by holding the outer surface of the projection 16 in sliding contact with the slanted surfaces 39 of the narrowed portions 38 to suppress widthwise shaking of the terminal fitting 10 and to enable the smooth insertion of the terminal fitting 10. At this stage, the lock 31 is deformed into a arch shape with the couplings at the front and rear ends as supports (FIG. 8).

The terminal fitting 10 inserted into the cavity 21 at the lower stage slides in contact with the bottom surfaces of the excessive deformation preventing portions 43. Accordingly, even if the terminal fitting 10 inclines up toward the adjacent cavity 21, the bottom surfaces of the two excessive deformation preventing portions 43 engage the terminal fitting 10 and prevent the terminal fitting 10 from entering the deformation permitting space 34 at the upper stage and prevent vertically shaking.

The projection 16 moves beyond the locking section 33 and enters the groove 45 when the terminal fitting 10 is inserted to a proper depth. Additionally, the arm 32 is restored resiliently and the locking section 33 enters the escaping hole 15 of the main body 11. Thus, the front surface of the locking section 33 engages the projection 16 and the front edge of the escaping hole 15, as shown in FIG. 10, for partly locking the terminal fitting 10. At this time, the two narrowed portions 38 of the locking section 33 engage the portions of the front edge of the escaping hole 15 at the opposite sides of the projection 16 and the portion of the locking section 33 more toward the base end than the narrowed portions 38 engages substantially the entire rear end surface of the projection 16. The slanted surfaces 21*a*, 32*a* on the ceiling and bottom surfaces of the cavity 21 guide the terminal fitting 10 toward the proper depth, and the front end of the terminal fitting 10 fits into the vertically narrowed front end portion of the cavity 21.

Figure 11:
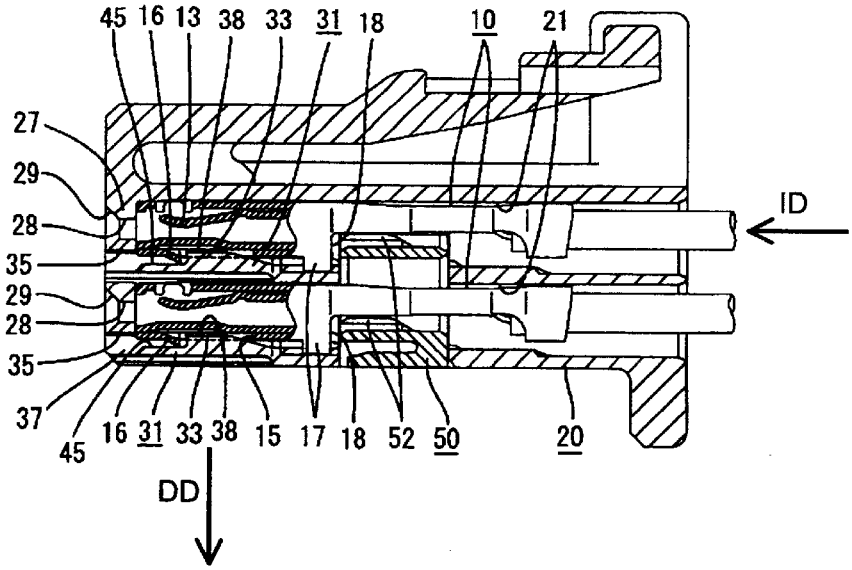
FIG. 11 is a side view in section showing a state where the retainer is located at a full locking position.

The retainer 50 is pushed from the partial locking position to the full locking position when all of the terminal fittings 10 have been inserted into the cavities 21. Then, as shown in FIG. 11, the terminal fittings 10 are doubly locked by the engagement of the locking projections 52 of the retainer 50 with the jaws 18 of the main bodies 11. As a result, the terminal fittings 10 are held so as not to come out of the housing 20.

Figure 13:
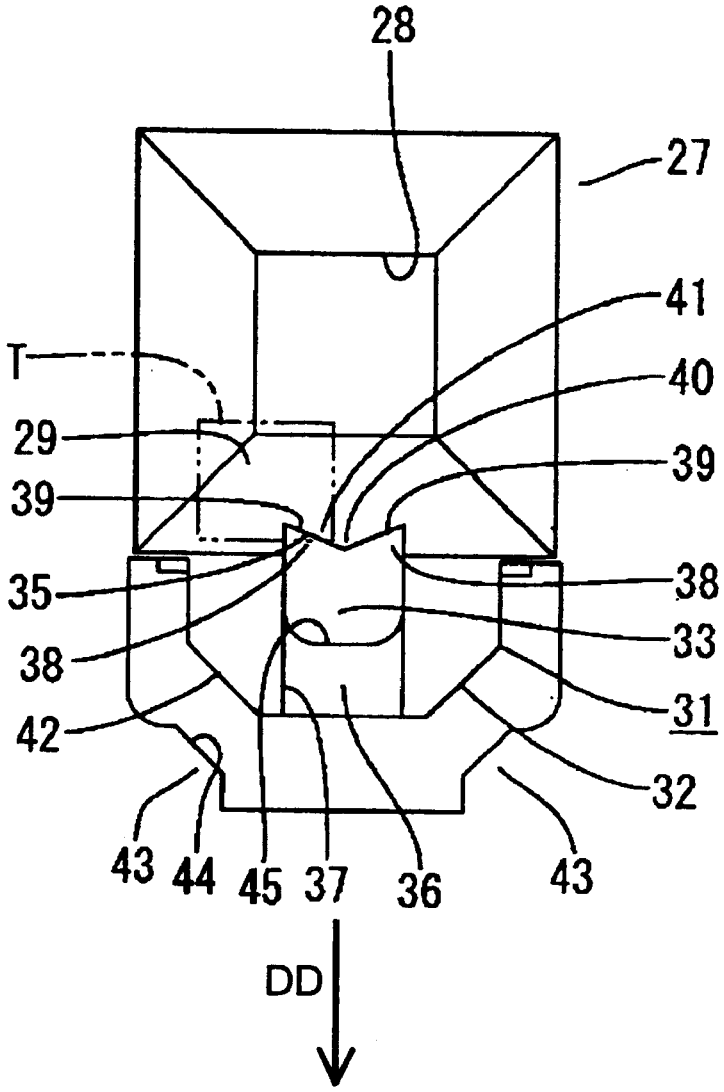
FIG. 13 is an enlarged front view showing a state where the tab terminal is misaligned and held in contact with a guide surface and an auxiliary guide surface at the upper stage.

The assembled female connector can be connected with the unillustrated mating male connector. As the male connector is connected with the female connector from the front, the tab terminals T of the male connector enter the cavities 21 through the tab insertion holes 28 and then enter the main bodies 11 of the terminal fittings 10. Thus, the tab terminals T are brought resiliently into contact with the resilient contact pieces 13 (see FIG. 11). The tab terminals T are aligned for insertion into the center positions of the tab insertion holes 28 as shown in FIG. 12. However, the tab terminals T may be misaligned due to the deformation of the tab terminals T themselves. For example, a tab terminal T that is displaced obliquely down to left with respect to the tab insertion hole 28, as shown in FIG. 13, is held in sliding contact with both the guide surface 29 and the auxiliary guide surfaces 41. As a result, the tab terminal T is guided smoothly toward the tab insertion hole 28.

Figure 16:
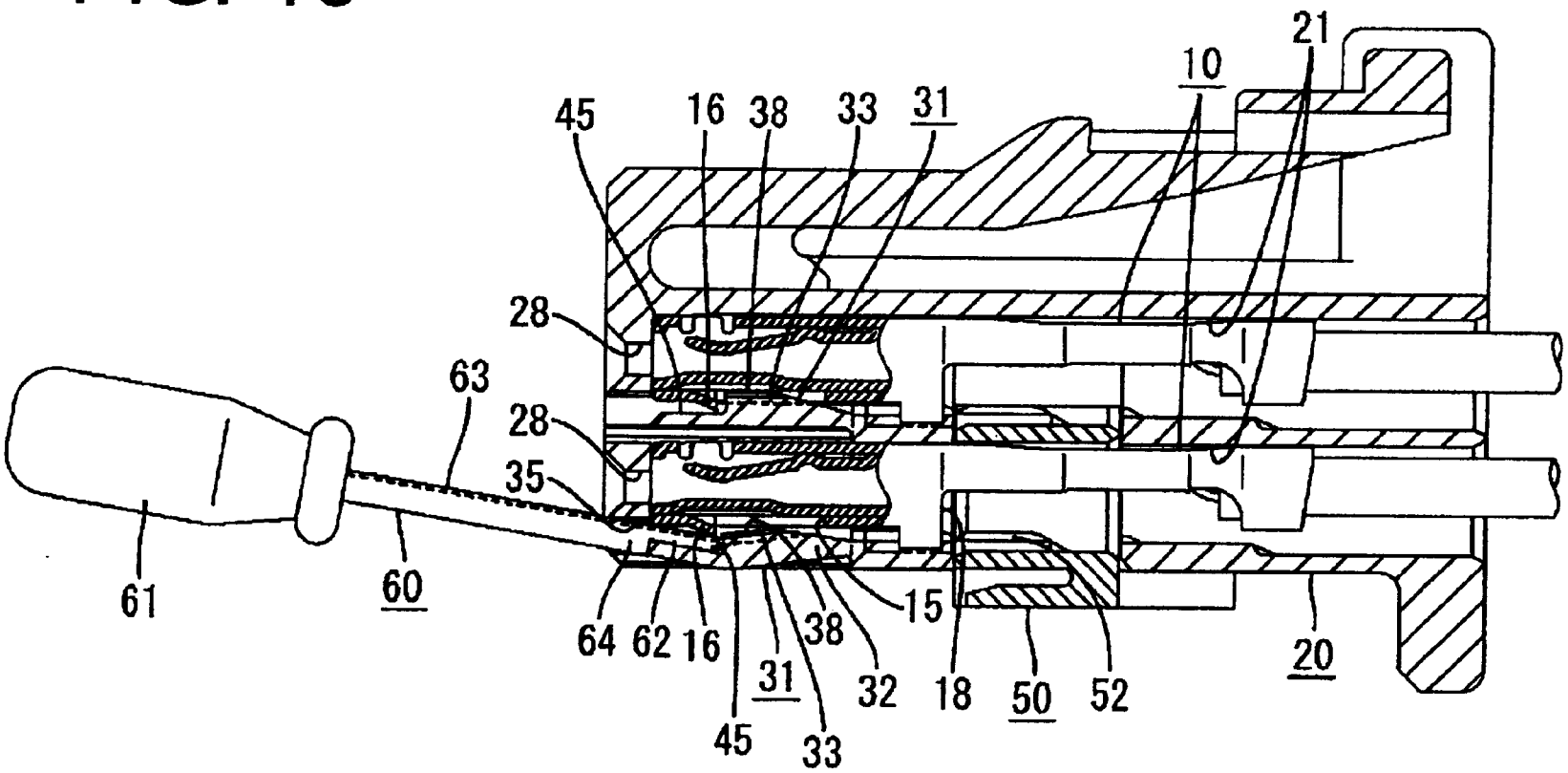
FIG. 16 is a side view in section showing a state where a locking portion is resiliently deformed by the disengagement jig.

The terminal fitting 10 may have to be withdrawn from the housing 20 for maintenance or other reason. In such a case, the retainer 50 is returned to the partial locking position, as shown in FIG. 15. The shaft 62 and the two reinforcing ribs 63 of the disengagement jig 60 are inserted into the first mold-removal hole 35 from the front of the housing 20, and the restricting portion 64 is inserted into the second mold-removal hole 37. During this inserting process, the two reinforcing ribs 63 are inserted into the portions of the first mold-removal hole 35 corresponding to the two narrowed portions 38 and are held in sliding contact with the inner surface of the first mold-removal hole 35 to suppress widthwise shaking of the disengagement jig 60. The shaft 62 could be inclined slightly. However, the leading end of the shaft 62 slidably contacts the guide surface 36, and the shaft 62 assumes a proper horizontal orientation for smooth insertion to the back of the first mold-removal hole 35. The leading end of the shaft 62 slides in contact with the front surface of the projection 16 of the terminal fitting 10 and is guided obliquely down. The grip 61 then is inclined up while the leading end of the shaft 62 is guided. Thus, the inner surface of the first mold-removal hole 35 is pressed down by the shaft 62 to forcibly resiliently deform the arm 32, as shown in FIG. 16. The terminal fitting 10 can be pulled out of the cavity 21 when the arm 32 is deformed sufficiently for the locking section 33 to disengage completely from the projection 16. During this process, the restricting portion 64 engages the guide surface 36 to restrict the inserted depth of the disengagement jig 60. Hence, the leading ends of the shaft 62 and the two reinforcing ribs 63 cannot interfere with the locking section 33. Therefore, the disengagement jig 60 cannot be stuck in the lock 31 and/or against the locking section 33, damage is avoided.

An excessive operating force may be exerted by the jig 60 to resiliently deform the lock 31 more than necessary. In such a case, as shown in FIG. 18, the slanted surfaces 42 of the arm 32 substantially simultaneously engage the slanted receiving surfaces 144 of the excessive deformation preventing portions 43 before the arm 32 is deformed to its resilient or elastic limit. Thus, further deformation of the arm 32 can be prevented and the lock 31 is not damaged or plastically deformed. At this time, the engaged slanted surfaces 42 and the slanted receiving surfaces 44 are inclined. Thus, a pushing force that acts on the excessive deformation preventing portions 43 when the slanted surfaces 138 engage the slanted receiving surfaces 44 can be alleviated.

Figure 17:
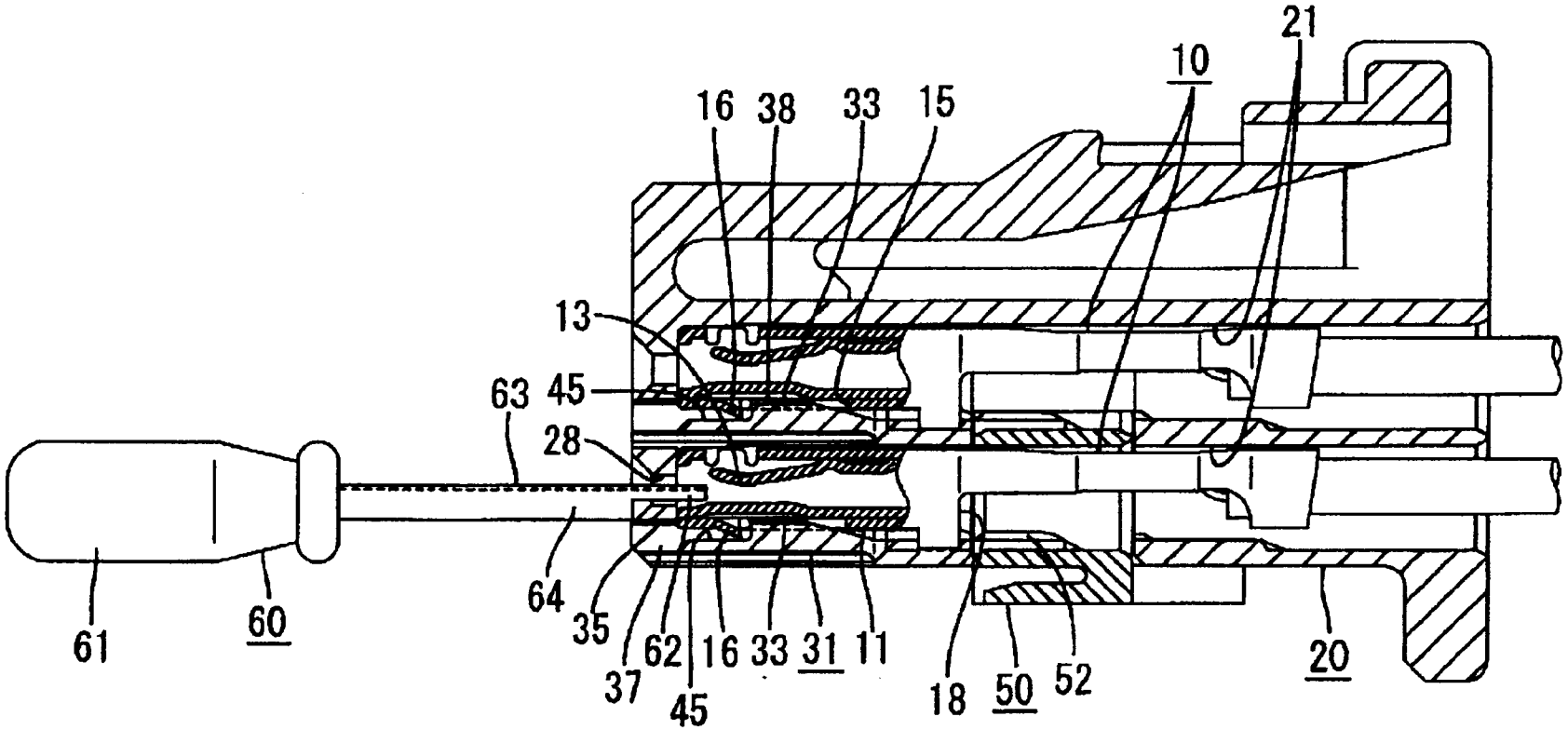
FIG. 17 is a side view in section showing a state where the disengagement jig is inserted into the tab insertion hole.

The front walls 27 of the housing 20 are formed with the tab insertion holes 28 right above the mold-removal holes 35, 37. Thus, an operator may erroneously insert the disengagement jig 60 into the tab insertion hole 28. In such a case, as shown in FIG. 17, the restricting portion 64 engages the front surface of the front wall 27 and prevents the disengagement jig 60 from being inserted sufficiently to iterfere with the resilient contact piece 13, even though the shaft 62 and the reinforcing ribs 63 are inserted into the cavity 21 and the main body 11 of the terminal fitting 10. Thus, the disengagement jig 60 will not strike against and damage the resilient contact piece 13. The operator can detect an erroneous insertion of the disengagement jig 60 by the hindrance to the further insertion of the disengagement jig 60.

As described above, the narrowed portions 38 are narrowed toward their leading ends along their height direction and are provided at the part of the locking section 33 of the lock 31 that overlaps the guide surface 29. Additionally, the portions of the first mold-removal hole 35 corresponding to the narrowed portions 38 are shaped to conform substantially to the outer peripheries of the narrowed portions 38. Thus, an area of the guide surface 29 cut out by the first mold-removal hole 35 can be made smaller as much as the narrowed portions are formed narrower. Conversely, an area with which the tab terminal T is held substantially in sliding contact can be enlarged as much as the auxiliary guide surface 41. Thus, the tab terminal T can be guided smoothly to the tab insertion hole 28.

The groove 45 is formed at a position on the arm 32 immediately before the locking section 33 and the projection 16 of the terminal fitting 10 is inserted into the groove 45 for engagement with the locking section 33. Thus, a distance between the leading end of the locking section 33 with respect to height direction and the tab insertion hole 28 can be made larger by the height of the groove 45 while ensuring a sufficiently large engaged area of the locking section 33 with the projection 16. Thus, a distance between a part of the first mold-removal hole 35 cutting out the front wall 27 and the tab insertion hole 28 can be made larger, and a large area can be ensured for the guide surface 29 with which the tab terminal T is to be held in sliding contact. Therefore, the tab terminal T can be guided smoothly to the tab insertion hole 28.

Two narrowed portions 38 are at the opposite widthwise ends of the lock 31, and therefore the widths of the portions of the first mold-removal hole 35 corresponding to the narrowed portions 38 can be made smaller. Thus, interrupted portions of the guide surface 29 and the auxiliary guide surface 41 are divided into two sections and the widths of the individual interrupted portions are smaller. The tab terminal T can be guided more smoothly.

The height of the opposite bottom ends of the M-shaped portion of the first mold-removal hole 35 and that of the recessed middle point of the M-shaped portion are aligned substantially. Thus, the tab terminal T can be guided more smoothly.

The projection 16 of the terminal fitting 10 is held in sliding contact with the slanted surfaces 39 between the narrowed portions 38. Thus, widthwise shaking of the terminal fitting 10 can be suppressed. Further, the two slanted surfaces 39 are inclined inversely of each other. Hence, the terminal fitting 10 can be guided toward the widthwise center to further suppress the widthwise shaking, making the insertion operability of the terminal fitting 10 better.

The rear end of the projection 16 of the terminal fitting 10 engages the locking section 33 of the lock 31, while the front of the projection 16 guides the terminal fitting 10 into the cavity 21. Thus, the construction of the terminal fitting 10 can be simplified.

The portion of the locking section 33 more toward the base end than the narrowed portions 38 engages the projection 16. Thus, a larger shear area engageable with the terminal fitting 10 is ensured, as compared to a case where the narrowed portions 38 are engaged with the projection 16. As a result, a force to lock the terminal fitting 10 can be increased.

The two reinforcing ribs 63 on the shaft 62 of the jig 60 are insertable into the portions of the first mold-removal hole 35 corresponding to the narrowed portions 38. Thus, the disengagement jig 60 is strong even if the shaft 62 is narrowed as the connector is miniaturized to thereby reduce the opening areas of the first mold-removal holes 35.

The inserted depth of the disengagement jig 60 is restricted by engagement of the restricting portion 64 with the guide surface 36 at the front surface of the lock 31. This engagement occurs before the shaft 62 and the reinforcing ribs 63 inserted into the first mold-removal hole 35 interfere with the locking section 33. As a result, the disengagement jig 60 will not damage the lock 31. Further, the disengagement jig 64 could mistakenly be inserted in the tab insertion hole 21. However, the restricting portion 64 will engage the front surface of the front wall 27 to restrict the inserted depth and prevent the leading. ends of the shaft 62 and the reinforcing ribs 63 from contacting and damaging the resilient contact piece 13. In this way, the restricting portion 64 prevents the disengagement jig 60 from striking against the lock 31 and the function of preventing an erroneous insertion of the disengagement jig 60 into the tab insertion hole 28. Thus, the construction of the disengagement jig 60 can be simplified as compared, for example, to a case where two restricting portions are provided for the respective functions.

As described above, the slanted surfaces 44 of the arm 32 are retracted up from the bottom end surface 32*b* of the arm 32 and the excessive deformation preventing portions 43 overlap the portion of the deformation permitting space 34 for letting the bottom end surface 32*b* of the arm 32 escape with respect to the deformation direction DD. Thus, the excessive deformation preventing portions 43 are closer to the locking portion 31 as much as the slanted surfaces 42 are retracted, and the connector can be made smaller as much as the excessive deformation preventing portions 43 and the deformation permitting spaces 34 overlap.

Further, since the slanted receiving surfaces 44 are inclined, the pushing force on the excessive deformation preventing portions 43 when the slanted surfaces 42 engage the slanted receiving surfaces 44 can be alleviated. This eliminates the need for a special consideration to enhance the strength of the excessive deformation preventing portions 43, thereby improving a degree of freedom in the connector designing.

The locks 31, the deformation permitting spaces 34 and the excessive deformation preventing portions 43 at the upper stage are formed by cutting, recessing and/or forming the partition walls 22 that partition the vertically adjacent cavities 21. Thus, the deformation permitting spaces 34 at the upper stage communicate with the cavities 21 at the lower stage, and the excessive deformation preventing portions 43 at the upper stage engage the terminal fittings 10 inserted into the cavities 21 at the lower stage. Therefore, the entrance of the terminal fittings 10 into the deformation permitting spaces 34 located above can be prevented and the shaking of the terminal fittings 10 can be suppressed.

The locks 31, the deformation permitting spaces 34 and the excessive deformation preventing portions 43 at the lower stage are formed by cutting, recessing and/or forming the bottom wall 23, which is the outer wall of the housing 20. Thus, the deformation permitting spaces 34 at the lower stage communicate with the outside below to expose the lock 31 to the outside, whereas the bottom sides of the locks 31 at the lower stage are covered partly by the excessive deformation preventing portions 43. Thus, the interference of external matter with the locks 31 from the outside is difficult, thereby maximally preventing the locks 31 from being damaged.

A second embodiment of the invention is described with reference to FIG. 19. In this second embodiment, a narrowed portion is provided substantially at the widthwise center of the locking section to shortening the height of the female connector.

Figure 19:
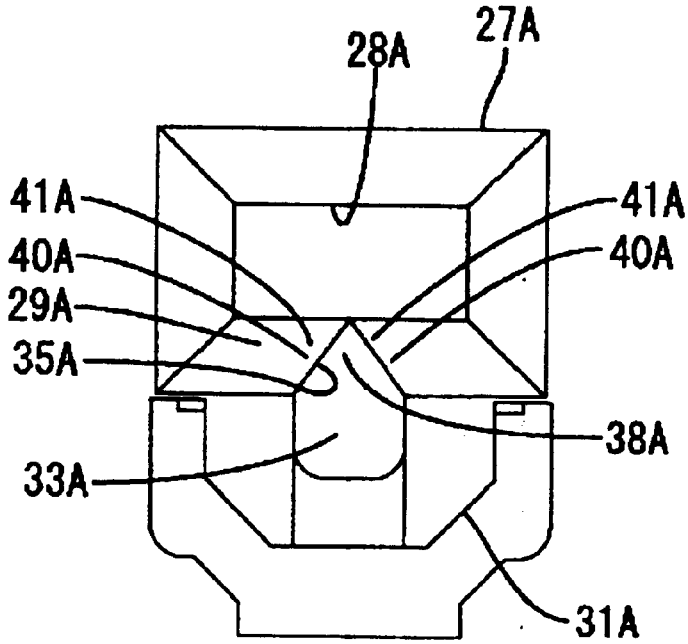
FIG. 19 is an enlarged front view of a housing according to a second embodiment of the invention.

A small female connector has a lock 31A with a locking section 33A that reaches a height of both a guide surface 29A and a tab insertion hole 28A, as shown in FIG. 19. A narrowed portion 38A is provided at the widthwise center of the locking section 33A. The narrowed portion 38A has its base end connected with the locking section 33A over the substantially entire width of the locking section 33A, and has a substantially isosceles triangular shape that gradually narrows toward its projecting end. The tip of the narrowed portion 38A reaches the bottom end of the tab insertion hole 28A. Accordingly, a portion of a first mold-removal hole 35A corresponding to the narrowed portion 38A defines an inverted V-shape and communicates with the tab insertion hole 28A. Thus, left and right jutting portions 40A are provided at the opposite sides of the edge of the first mold-removal hole 35 and are formed with auxiliary guide surfaces 41A substantially continuous with the guide surface 29A. Therefore, areas for guiding tab terminals can be enlarged.

Figure 20:
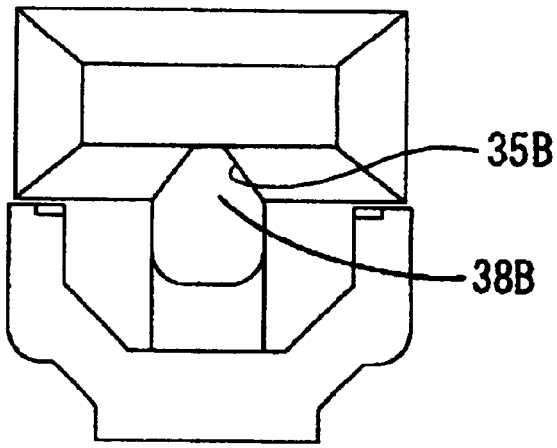
FIG. 20 is an enlarged front view of a housing according to another embodiment of the invention.
Figure 21:
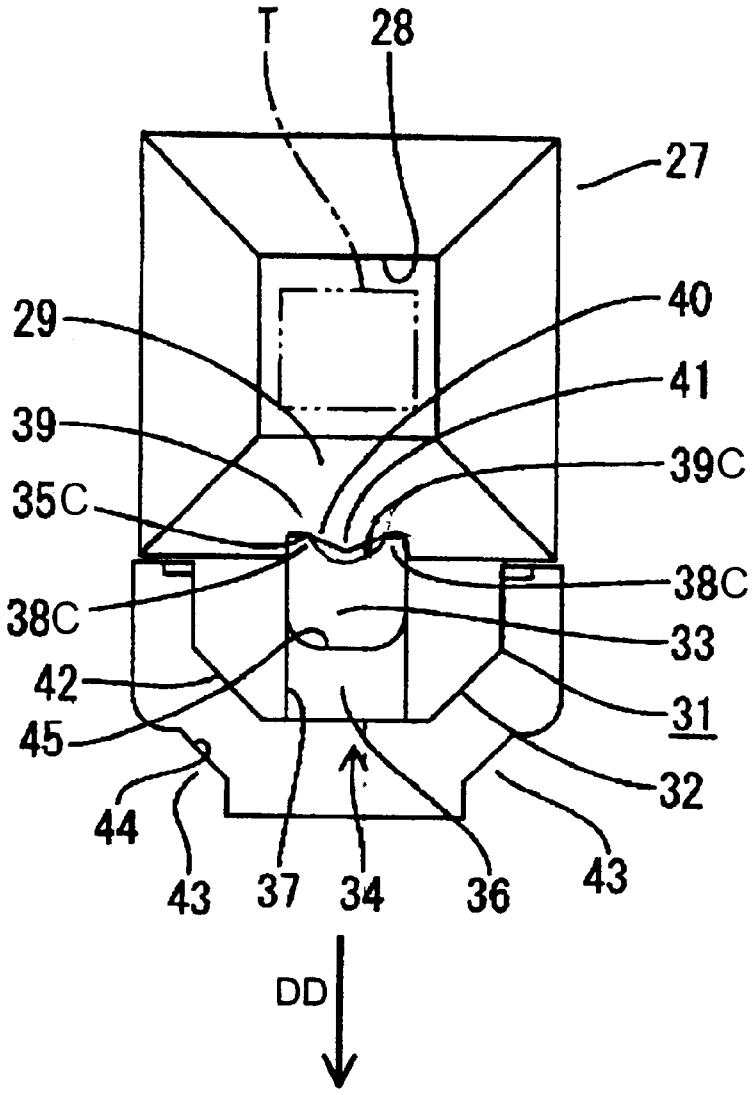
FIG. 21 is a partial enlarged front view of a housing according to a further embodiment of the invention.
Figure 22:
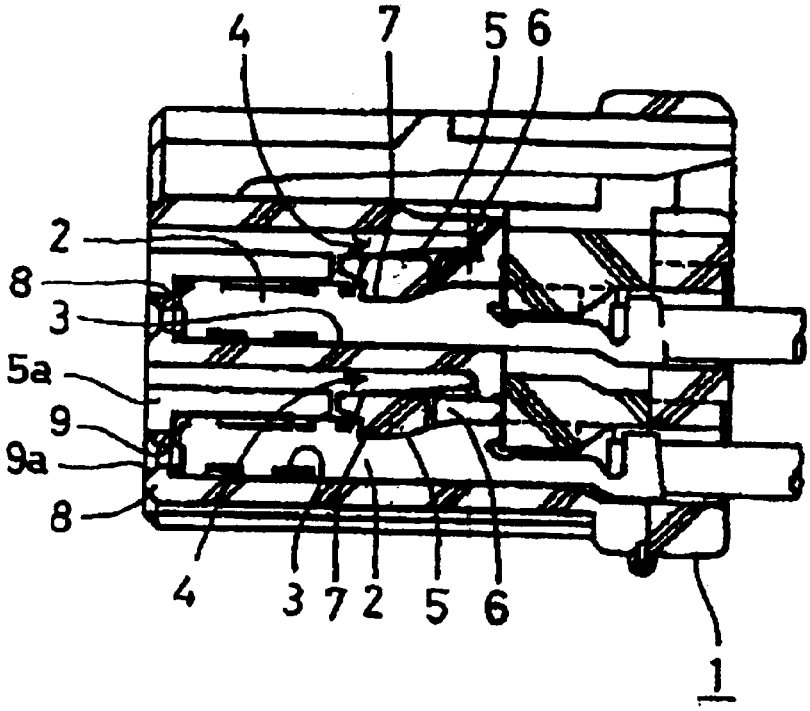
FIG. 22 PRIOR ART
FIG. 22 is a section of a prior art connector.

The narrowed portions 38 of the first embodiment and the narrowed portion 38A of the second embodiment are tapered to well defined points (see FIGS. 12 and 19). Similar well defined pointed tapers are formed on the first mold removal hole 35 of the first embodiment and the first mold removal hole 35A of the second embodiment. However, with each of these optional embodiments, the narrowed portion may be truncated. Thus, FIG. 20 shows an embodiment similar to the second embodiment of FIG. 19, but with a narrowed portion 38B that is truncated to define a generally trapezoidal cross-sectional shape. A similarly configured truncated and trapezoidal cross-section is provided for the first mold removal hole 35B in the embodiment of FIG. 20. In a similar manner, FIG. 21 shows an embodiment similar to the first embodiment of FIG. 12. However, the narrowed portions 38C each are truncated in FIG. 1, and the first mold removal hole 35C in FIG. 21 is similarly truncated. The truncated narrow portions 38B and 38C shown in FIGS. 20 and 21 make the height of the female connector even shorter. FIG. 21 shows another variation from the first embodiment. In particular, the molding process may result in a locking section 33C that does not perfectly follow the shape of the first mold removal hole 35C. Thus, the oblique sliding contact surfaces 39 described above and illustrated with respect to the first embodiment may actually define an arcuate surface. Accordingly, the narrowed portions 38C may not perfectly align with the shapes defined by the first mold removal hole 35C. However, there is at least a partial overlapping or alignment and a substantially similar tapering shape as shown in FIG. 21.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the two narrowed portions are transversely symmetrical in the first embodiment, connectors in which the two narrowed portions and the first mold-removal holes are transversely asymmetrical also are embraced by the present invention. The narrowed portions can take any desired shape besides the triangular shape.

Although two narrowed portions are provided at the opposite widthwise ends of each locking section in the first embodiment, one narrowed portion may be provided at substantially the widthwise center of the locking section as in the second embodiment in connectors in which the first mold-removal holes do not communicate with the tab insertion holes as in the first embodiment.

Although the bottom ends of the auxiliary guide surfaces and the guide surfaces substantially align in the first embodiment, the bottom ends of the auxiliary guide surfaces can be lower than that of the guide surface by setting the bottom ends of the narrowed portions lower.

Although the projection of the terminal fitting is held substantially in sliding contact with the slanted surfaces between the two narrowed portions in the first embodiment, the present invention is also applicable, for example, to connectors in which terminal fittings each having no projection are accommodated in a housing.

The restricting portion of the disengagement jig has the function of preventing the disengagement jig from striking against the locking portion and the function of preventing the erroneous insertion of the disengagement jig into the tab insertion hole in the first embodiment. However, the shaft may have two portions specially adopted for the respective functions. Such an embodiment is particularly effective in the case that the distance from the front surface of the locking section to the guide surface and the distance from the front end of the resilient contact piece to the front surface of the front wall differ.

The inserted depth of the disengagement jig into the first mold-removal hole is restricted by the engagement of the restricting portion with the guide surface of the lock in the first embodiment. However, an embodiment in which the front surface of the restricting portion is set to prevent the disengagement jig from striking against the lock by the engagement of the restricting portion with the front surface of the housing also is embraced by the present invention.

Although the narrowed portions are transversely symmetrical in the illustrated embodiment, an embodiment in which the narrowed portion is transversely asymmetrical also is embraced by the present invention.

Although the locks are supported at both ends in the foregoing embodiments, the invention is also applicable to locks supported at one end.

The narrowed portions are on the locking sections of the locks and the grooves that receive the projections of the terminal fittings are formed in the arms in the foregoing embodiments. However, either the narrowed portions or the grooves may be deleted according to the invention. Such an embodiment ensures a large area for the guide surfaces as compared with an embodiment in which neither the narrowed portions nor the grooves are provided. Thus the tab terminals can be guided smoothly to the tab insertion holes.

The resilient contact 13 projects forward from the base plate 10*a* in the foregoing embodiments. However, the invention is also applicable to terminal fittings in which the resilient contact projects back from a front end of the terminal fitting.

The slanted surfaces are on the engaging portions of the lock in the first embodiment. However, the slanted surfaces may be formed on the excessive deformation preventing portions and corners of the lock may be engaged with these slanted surfaces.

Although the two excessive deformation-preventing portions are transversely symmetrical in the first embodiment, they may be transversely asymmetrical according to the invention. Further, the shape of the excessive deformation preventing portions can be set at a desired one.

Although the connector has cavities at two stages in the foregoing embodiments the invention is also applicable to connectors with cavities at three or more stages or those having cavities at one stage.

What is claimed is:

1. A connector having a housing (20) opposite front and rear ends, said housing (20) comprising:

a front wall (27) at the front end of the housing (20);

cavities (21) extending longitudinally into the housing (20) from the rear end to the front wall (27);

tab insertion holes (28; 28A) formed through the front wall (27) and aligned respectively with said cavities (21), each said tab insertion hole (28; 28A) having an inwardly tapered guide surface (29; 29A) extending from the front end of the housing (20) into the respective tab insertion hole (28; 28A);

a lock (31; 31A) on an inner surface of each of said cavities (21), the lock (31; 31A) having a locking section (33; 33A) aligned longitudinally with the guide surface (29; 29A), the locking section (33; 33A) having at least one elongate narrowed portion (38; 38A; 38B) tapering to narrow widths at locations further into the cavity (21); and a mold-removal hole (35; 35A) formed through the front wall (27) of the cavity (21) and aligned longitudinally with at least part of the narrowed portion (38; 38A; 38B), the mold-removal hole (35; 35A) having a cross sectional shape substantially conforming at least part of the narrowed portion (38; 38A; 38B).

2. The connector of claim 1, wherein an end of the narrowed portion (38A; 38B) furthest into the cavity (21) is aligned longitudinally with the respective tab insertion hole (28; 28A), and wherein the narrowed portion (38A; 38B) is formed substantially at the widthwise center of the lock (31; 31A).

3. The connector of claim 1, wherein two narrowed portions (38) are formed respectively at the opposite lateral sides of each of said locks (31) for defining substantially an M-shape on each of said locks (31) and a substantially conforming M-shape defined for each of said mold removal holes (35; 35A).

4. The connector of claim 3, wherein the two narrowed portions (38) on each of said locks (31) are substantially identical and are disposed substantially symmetrically on the respective locks (31).

5. The connector of claim 1, further comprising terminal fittings (10) locked in the respective cavities (21) by the locking sections (33; 33A).

6. The connector of claim 5, comprising sliding-contact surfaces (39) between the two narrowed portions (38) of each of said locks (31) for sliding contact with a projection (16) on the respective terminal fitting (10) to guide the terminal fitting (10) into the cavity (21).

7. The connector of claim 6, wherein the sliding-contact surfaces (39) are inclined inversely of each other.

8. The connector of claim 6, wherein each respective lock (31) is engageable with a rear end of the projection (16).

9. The connector of claim 8, wherein a portion (33) of each said lock (31; 31A) engageable with the respective terminal fitting (10) is more toward the base end of the lock (31; 31A) than the narrowed portions (38; 38A; 38B).

10. The connector of claim 9, wherein each of the locks (31; 31A) has a resiliently deformable arm (32), the locking section (33; 33A) projecting from the arm (32), the arm (32) having a groove (45) immediately before the locking section (33; 33A) for receiving a projection (16) on the terminal fitting (10).

11. A disengagement jig (60) for the connector of claim 10, comprising:

a shaft (62) which is insertable into the mold-removal hole (35; 35A) for deforming the lock (31; 31A); and a reinforcing rib (63) extending substantially along the longitudinal direction of the shaft (62) and insertable into the portion of the mold-removal hole (35; 35A).

12. The disengagement jig of claim 11, further comprising a restricting portion (64) cross sectionally large that the mold-removal hole (35; 35A) for engaging the housing (20) to restrict an inserted depth of the disengagement jig (60) into the mold-removal hole (35; 35A) to a position before the disengagement jig (60) interferes with the lock (31; 31A).

13. The disengagement jig of claim 12, wherein the restricting portion (64) is cross sectionally larger than tab insertion hole (28; 28A).

14. The disengagement jig of claim 11, wherein the restricting portion (64) is cross sectionally larger than tab insertion hole (28; 28A).

15. The connector of claim 1, further comprising a deformation space (34) for permitting the resilient deformation of the lock (31; 31A), and excessive deformation preventing portions (43) for preventing the lock (31; 31A) from being excessively resiliently deformed by engaging the lock (31; 31A), wherein an engaging surface (42) of the lock (31; 31A) with the excessive deformation preventing portion (43) is retracted from a leading end surface of the lock (31; 31A) with respect to the deforming direction (DD) thereof, and each excessive deformation preventing portion (43) is at a position overlapping a portion of the deformation space (34) for letting the leading end surface of the lock (31; 31A) escape with respect to the deforming direction (DD) of the lock (31; 31A).

16. The connector of claim 15, wherein an engageable surface (44) the excessive deformation preventing portion (43) to be engaged with the engaging surface (42) of the lock (31; 31A) is inclined.

17. The connector of claim 16, in which the cavities (21) are arranged at a plurality of stages along the deforming direction (DD) of the locks (31; 31A), the locks (31; 31A), the deformation spaces (34) and the excessive deformation preventing portions (43) being formed by cutting partition walls (22) partitioning the cavities (21) adjacent along the deforming direction (DD) of the locks (31; 31A), and the deformation spaces (34) are formed to communicate with the cavities (21) adjacent along the deforming direction (DD) of the locks (31; 31A), wherein each excessive deformation preventing portion (43) prevent loose movement of the terminal fittings (10) by being engaged with the terminal fitting (10) inserted into the adjacent cavity (21).

18. The connector of claim 17, in which the locks (31; 31A), the deformation spaces (34) and the excessive deformation preventing portions (43) are formed by cutting an outer wall (23) of the housing (20) and the deformation spaces (34) are formed to communicate with outside, wherein each excessive deformation preventing portion (43) can protect the corresponding lock (31; 31A) by covering an outer surface of the lock (31; 31A).

19. A connector having a housing (20) opposite front and rear ends, said housing (20) comprising:

a front wall (27) at the front end of the housing (20);

cavities (21) extending longitudinally into the housing (20) from the rear end to the front wall (27);

tab insertion holes (28; 28A) formed through the front wall (27) and aligned respectively with said cavities (21), each said tab insertion hole (28; 28A) having an inwardly tapered guide surface (29; 29A) extending from the front end of the housing (20) into the respective tab insertion hole (28; 28A);

a resilient deflectable lock (31; 31A) on an inner surface of each of said cavities (21), each said lock (31; 31A) having a bottom surface (32*b*) facing away from the cavity (21), slanted surfaces (42) extending up from opposite sides of the bottom surface (32*b*) and aligned to the bottom surface (32*b*) at an angle;

deformation-permitting spaces (34) sides of said locks (31; 31A) opposite the cavities (21) for permitting deformation of the locks (31; 31A);

excessive deformation preventing portions (43) projecting into the deformation-permitting spaces (34) and having receiving surfaces (44) facing the slanted surfaces (42) and aligned substantially parallel to the slanted surfaces (42) for contacting the slanted surfaces (42) and preventing excessive deformation of the respective lock (31; 31A).

* * * * *